US010714850B2

(12) United States Patent
Minich et al.

(10) Patent No.: US 10,714,850 B2
(45) Date of Patent: Jul. 14, 2020

(54) ELECTRICAL CONNECTOR ASSEMBLY

(71) Applicant: FCI USA LLC, Etters, PA (US)

(72) Inventors: Steven E. Minich, York, PA (US); Charles Copper, Hummelstown, PA (US)

(73) Assignee: FCI USA LLC, Etters, PA (US)

( * ) Notice: Subject to any disclaimer, the term of this patent is extended or adjusted under 35 U.S.C. 154(b) by 154 days.

(21) Appl. No.: 15/748,055

(22) PCT Filed: Jul. 27, 2016

(86) PCT No.: PCT/US2016/044247
§ 371 (c)(1),
(2) Date: Jan. 26, 2018

(87) PCT Pub. No.: WO2017/019763
PCT Pub. Date: Feb. 2, 2017

(65) Prior Publication Data

US 2018/0342822 A1 Nov. 29, 2018

Related U.S. Application Data

(60) Provisional application No. 62/197,319, filed on Jul. 27, 2015.

(51) Int. Cl.
*H01R 12/70* (2011.01)
*H01R 12/73* (2011.01)
*H01R 13/6585* (2011.01)

(52) U.S. Cl.
CPC ..... *H01R 12/70* (2013.01); *H01R 12/737* (2013.01); *H01R 13/6585* (2013.01)

(58) Field of Classification Search
CPC .. H01R 13/648; H01R 13/6582; H01R 24/62; H01R 13/516; H01R 13/514; H01R 12/712
See application file for complete search history.

(56) References Cited

U.S. PATENT DOCUMENTS 6,511,348 B1 1/2003 Wojtacki et al.
8,496,486 B2 * 7/2013 Szczesny ..... H01R 13/6585 439/79

(Continued)

FOREIGN PATENT DOCUMENTS

CN 101888032 A 11/2010
CN 101944680 A 1/2011

(Continued)

OTHER PUBLICATIONS

International Search Report and Written Opinion for International Application No. PCT/US2016/044247 dated Nov. 8, 2016.

(Continued)

*Primary Examiner* — Xuong M Chung Trans
(74) *Attorney, Agent, or Firm* — Wolf, Greenfield & Sacks, P.C.

(57) ABSTRACT

In accordance with one embodiment, first and second electrical connectors are configured as vertical electrical connectors that are configured to mate to each other so as to define a right angle electrical connector assembly. Ground shields and electrical contacts of various embodiments are also disclosed.

23 Claims, 15 Drawing Sheets

(56) References Cited

U.S. PATENT DOCUMENTS

| | | | | |
|---|---|---|---|---|
| 9,065,230 | B2 * | 6/2015 | Milbrand, Jr. ..... | H01R 12/724 |
| 9,257,778 | B2 * | 2/2016 | Buck ..... | H01R 13/516 |
| 9,905,975 | B2 | 2/2018 | Cartier, Jr. et al. | |
| 2010/0330820 | A1 | 12/2010 | Whiteman | |
| 2012/0214351 | A1 * | 8/2012 | Shiratori ..... | H01R 13/6471 439/692 |
| 2012/0289071 | A1 * | 11/2012 | Dodds ..... | H01R 12/724 439/183 |
| 2015/0104978 | A1 | 4/2015 | Hamner et al. | |

FOREIGN PATENT DOCUMENTS

| | | | |
|---|---|---|---|
| CN | 202259774 | U | 5/2012 |
| CN | 202308628 | U | 7/2012 |
| CN | 104577519 | A | 4/2015 |
| JP | 2011-175870 | A | 9/2011 |
| JP | 2013-152841 | A | 8/2013 |
| KR | 10-1452626 | B1 | 10/2014 |

OTHER PUBLICATIONS

International Preliminary Report on Patentability for International Application No. PCT/US2016/044247 dated Feb. 8, 2018.
Chinese Office Action for Application No. 201680040960.8 dated Jan. 29, 2019.

* cited by examiner

ELECTRICAL CONNECTOR ASSEMBLY

CROSS-REFERENCE TO RELATED APPLICATIONS

This application is a National Phase Entry of international PCT patent application No. PCT/US2016/044247, entitled "ELECTRICAL CONNECTOR ASSEMBLY" filed on Jul. 27, 2016, which claims priority to and the benefit of U.S. Provisional Application Ser. No. 62/197,319, entitled "ELECTRICAL CONNECTOR ASSEMBLY" filed on Jul. 27, 2015. The entire contents of these applications are incorporated herein by reference in their entirety.

BACKGROUND

Electrical connectors provide signal connections between electronic devices using electrically-conductive contacts. Electrical connectors define mating interfaces that are configured to mate with each other, and mounting interfaces that are configured to be mounted to respective electronic devices, such as printed circuit boards. One common configuration occurs where one of the electrical connectors is a vertical connector, such that its electrical contacts define mating ends and mounting ends proximate to first and second ends of the connector housing that are oriented parallel to each other. The other electrical connector is a right angle connector whereby its electrical contacts define mating ends and mounting ends proximate to first and second ends of the connector housing that are oriented perpendicular to each other. Accordingly, when the electrical connectors are mated to each other, the respective mounting interfaces are oriented perpendicular to each other. Furthermore, the substrates to which the mounting interfaces are mounted are oriented perpendicular to each other.

SUMMARY

In accordance with one embodiment, first and second electrical connectors are configured as vertical electrical connectors that are configured to mate to each other so as to define a right angle electrical connector assembly.

BRIEF DESCRIPTION OF THE DRAWINGS

The foregoing summary, as well as the following detailed description of a preferred embodiment of the application, will be better understood when read in conjunction with the appended drawings. For the purposes of illustrating the present disclosure, there is shown in the drawings a preferred embodiment. It should be understood, however, that the application is not limited to the precise arrangements and instrumentalities shown. In the drawings.

DETAILED DESCRIPTION

Figure 1A:
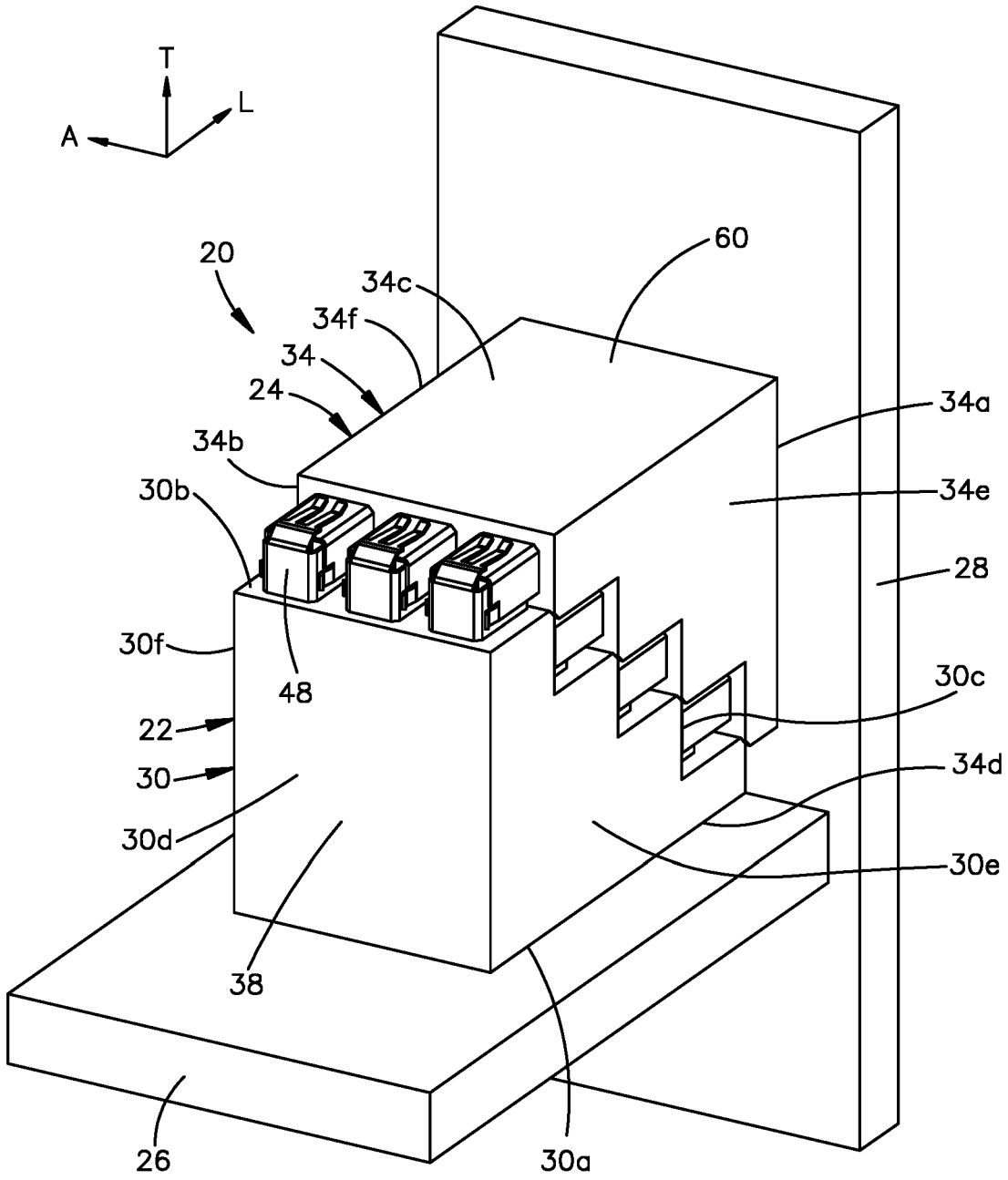
FIG. 1A is a perspective view of a right-angle electrical connector assembly including first and second electrical connectors mated to each other and mounted to respective first and second substrates.
Figure 1B:
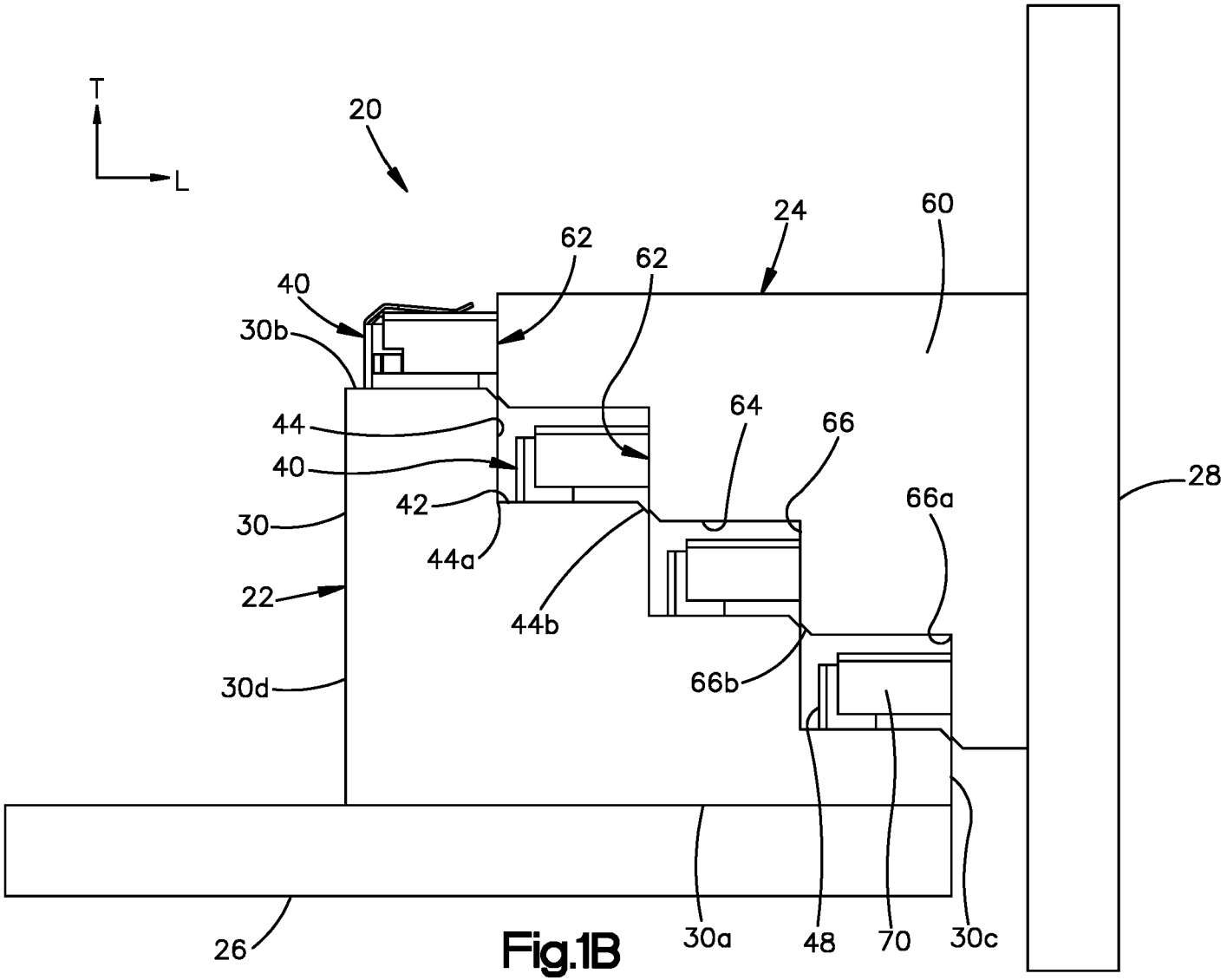
FIG. 1B is a side elevation view of the electrical connector assembly illustrated in FIG. 1A, with portions removed for the purposes of illustration.
Figure 2A:
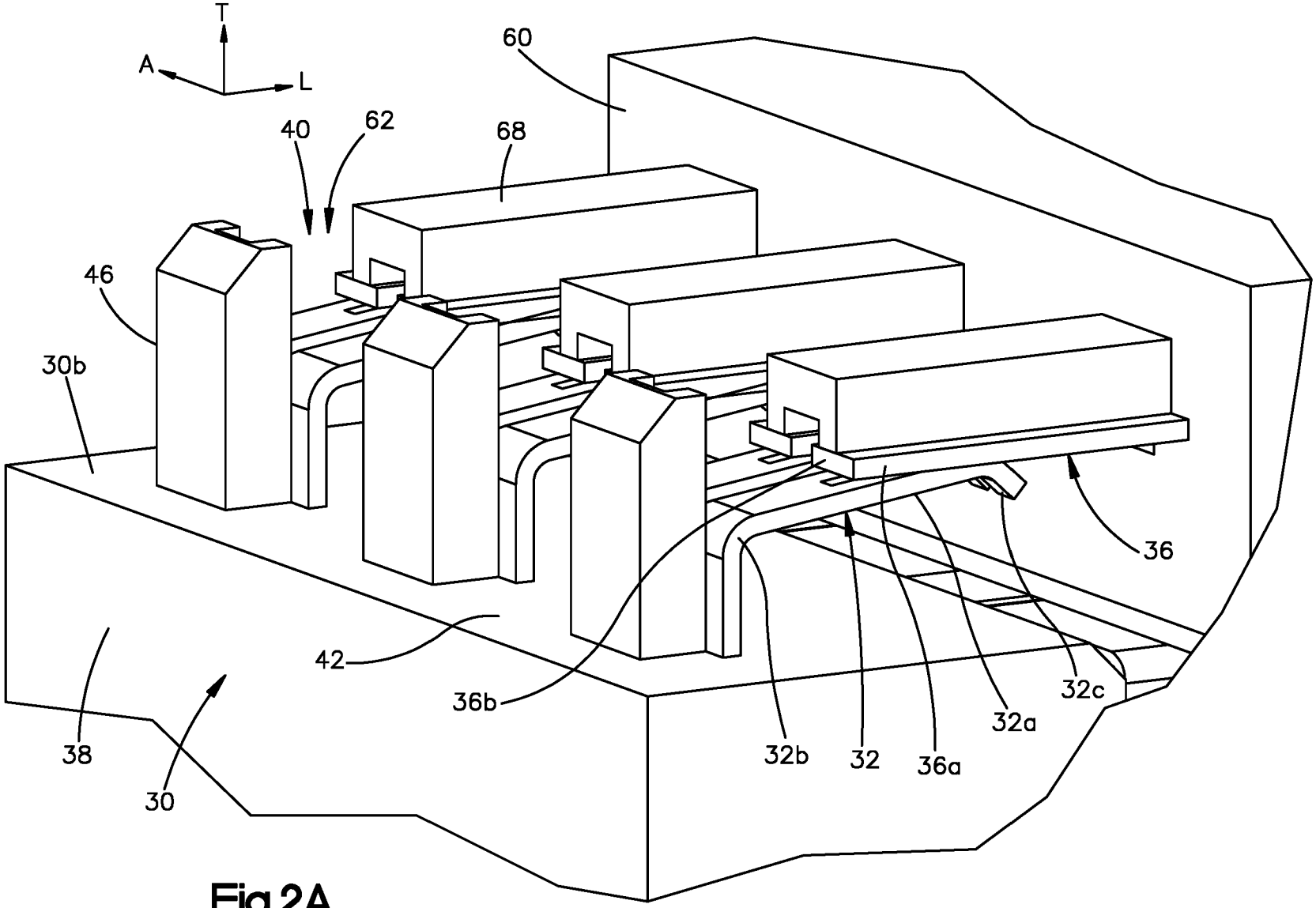
FIG. 2A is a perspective view of respective portions of the first and second electrical connectors illustrated in FIG. 1A as the first and second electrical connectors are mated to each other.
Figure 2B:
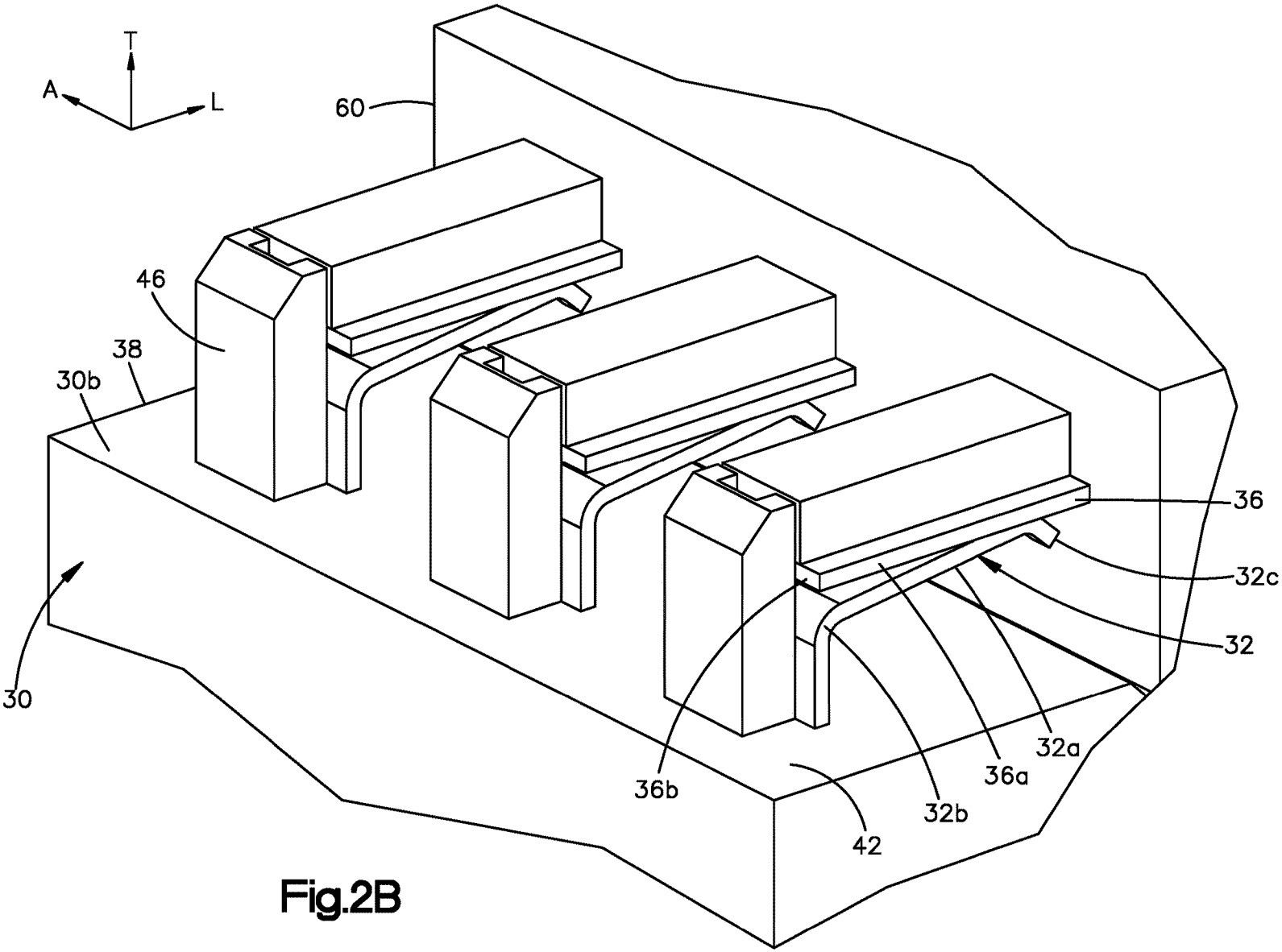
FIG. 2B is a perspective view of respective portions of the first and second electrical connectors as illustrated in FIG. 2A, shown when the first and second electrical connectors are mated to each other.
Figure 3A:
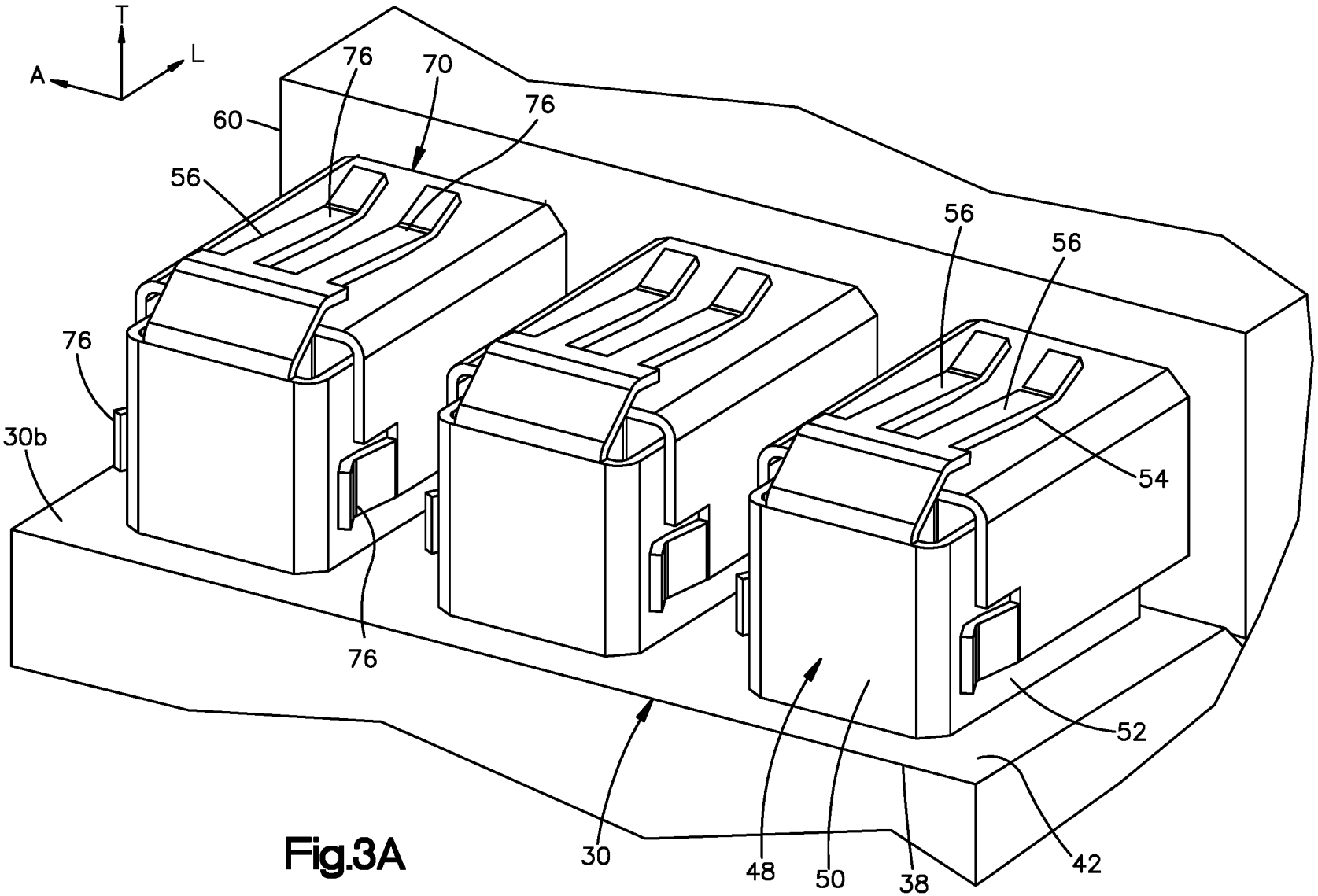
FIG. 3A is a perspective view of respective portions of the first and second electrical connectors as illustrated in FIG. 1A, showing respective ground shields when the first and second electrical connectors are mated to each other.
Figure 3B:
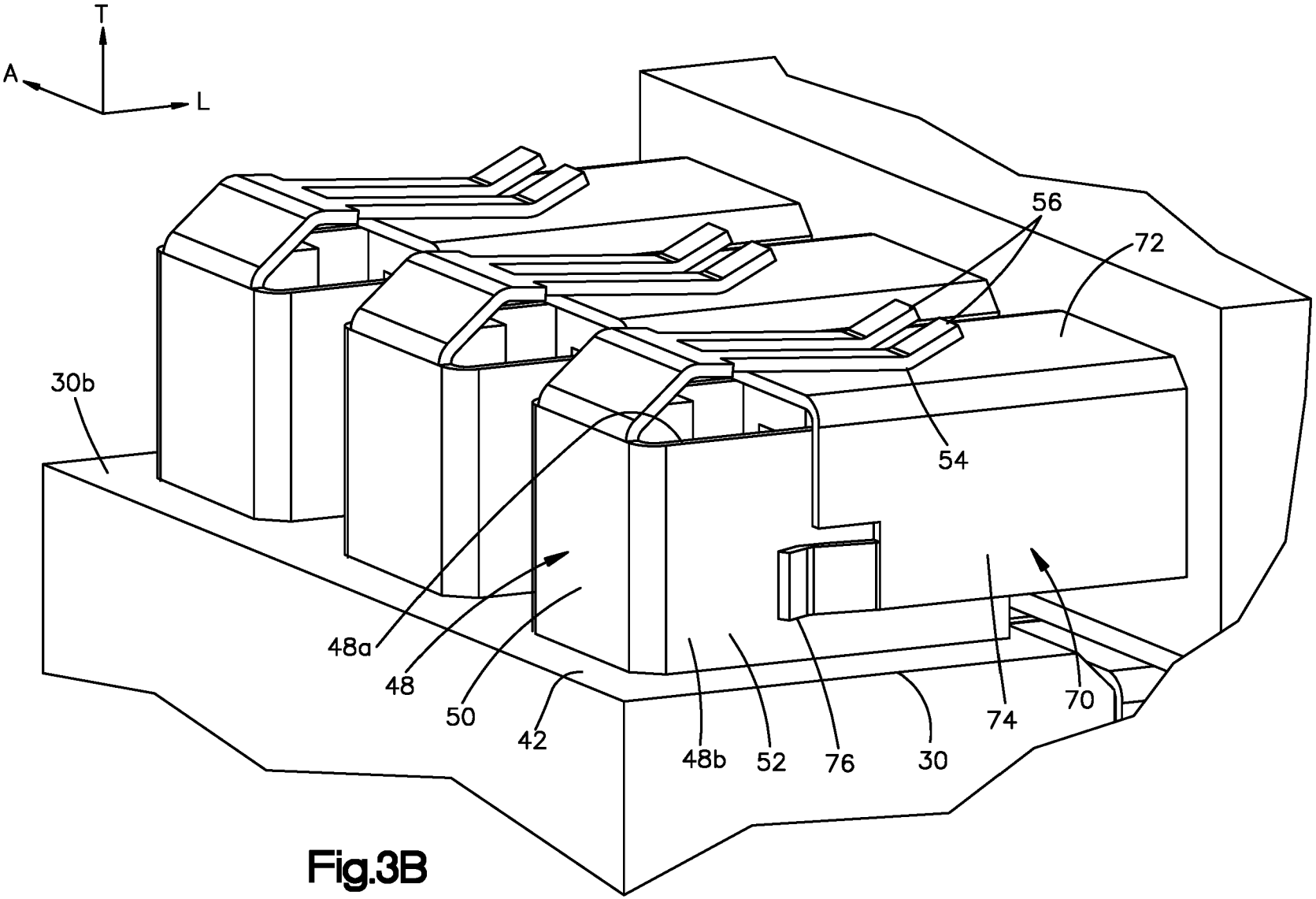
FIG. 3B is a perspective view of respective portions of the first and second electrical connectors as illustrated in FIG. 3A, showing respective ground shields while the first and second electrical connectors are being mated to each other.
Figure 3C:
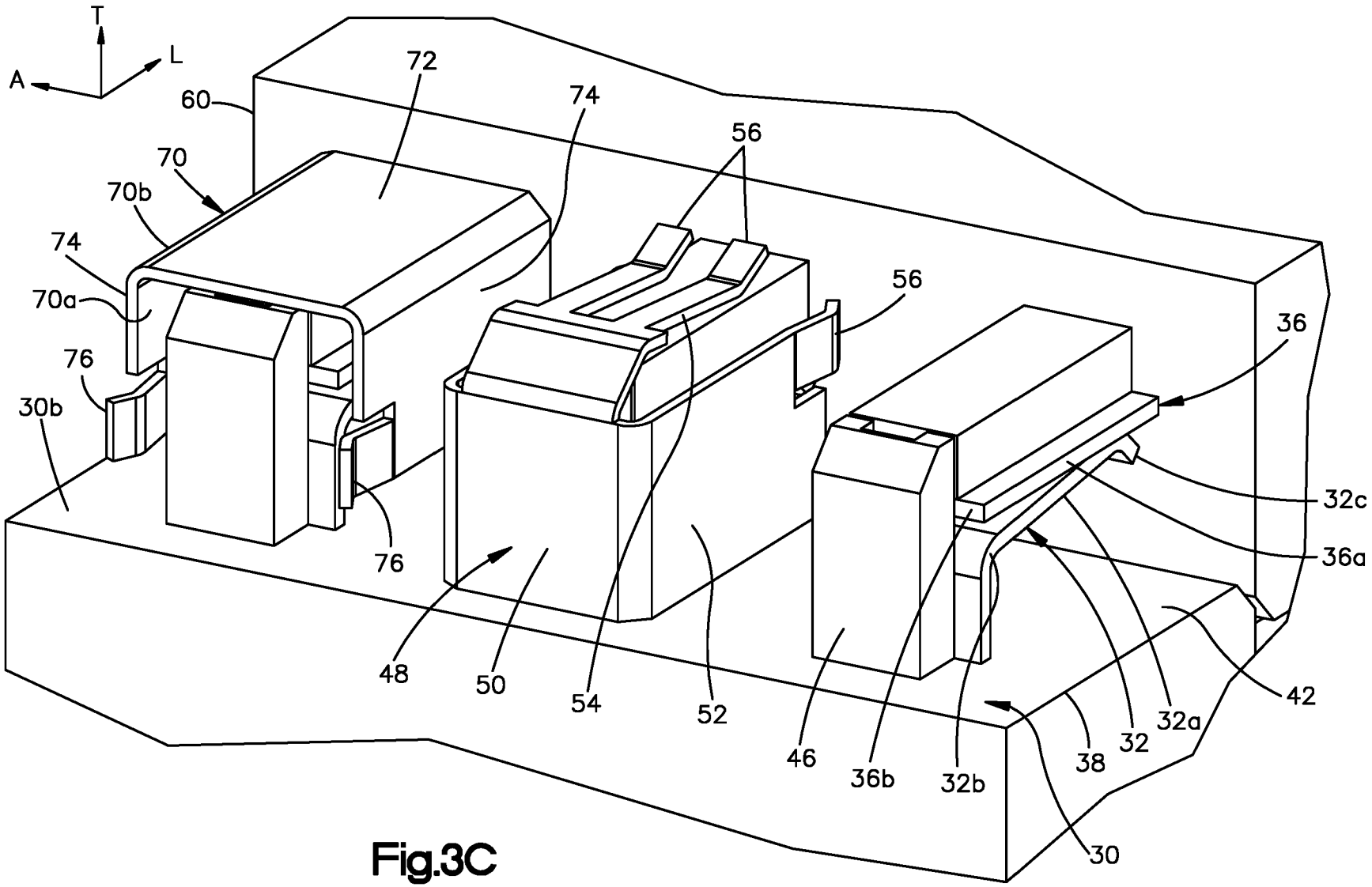
FIG. 3C is a perspective view of respective portions of the first and second electrical connectors as illustrated in FIG. 3A, with portions removed for the purposes of illustration.

Referring initially to FIGS. 1A-3C, an electrical connector assembly 20 includes a first electrical connector 22 and a second electrical connector 24 configured to mate with each other so as to establish an electrical connection between complementary first and second substrates 26 and 28. The first electrical connector 22 includes a first dielectric or electrically insulative connector housing 30 and a first plurality of electrical contacts 32 that are supported by the connector housing 30. The electrical contacts 32 define first mating ends 32*a* and first mounting ends opposite the mating ends. The electrical contacts 32 define mounting ends and mating ends that are disposed proximate to first and second ends 30*a* and 30*b*, respectively, of the connector housing 30 that are opposite each other. For instance, the mounting ends and mating ends of the electrical contacts 32 can extend out from the first and second ends 30*a* and 30*b*, respectively, of the connector housing 30 that are opposite each other. Accordingly, the electrical contacts 32 can be referred to as vertical electrical contacts. Thus, the first electrical connector 22 can be referred to as a vertical electrical connector.

Further, the connector housing 30 can define respective external surfaces at the first and second ends 30*a* and 30*b*, through which the electrical contacts 32 extend, and the respective external surfaces can be oriented substantially (within manufacturing tolerances) parallel to each other. The external surface at the first end 30*a* can be defined by a mounting interface of the connector housing 30. The external surfaces at the second end 30*b* can be defined by respective flats 42 as described in more detail below. For example, the connector housing 36 defines a respective external surface at the first end 36*a*, and respective external surfaces at the second end 36*b*, the at mating end of each of the electrical contacts 32 extends out the connector housing 30 through respective ones of the respective external surfaces at the second end 36*b*, the mounting end of each of the electrical contacts 32 extends out the connector housing 36 through the respective external surface at the first end 36*a*, and the respective external surfaces at the second end 36*b* are oriented substantially parallel to the respective external surface at the first end 36*a*. The electrical contacts 32 can be configured as electrical signal contacts. Similarly, the electrical contacts 36 can be configured as electrical signal contacts.

Similarly, the second electrical connector 24 includes a second dielectric or electrically insulative connector housing 34 and a second plurality of electrical contacts 36 that are supported by the connector housing 34. The electrical contacts 36 define second mating ends 36*a* and second mounting ends opposite the mating ends. The electrical contacts 36 can define mounting ends and mating ends that are disposed proximate to the first and second ends 34*a* and 34*b*, respectively, of the connector housing 34 that are opposite each other. For instance, the mounting ends and mating ends of the electrical contacts 36 can extend out from the first and second ends 34*a* and 34*b*, respectively, of the connector housing 34 that are opposite each other. Accordingly, the electrical contacts 36 can be referred to as vertical electrical contacts. Thus, the second electrical connector 24 can be referred to as a vertical electrical connector. Further, the connector housing 34 can define respective external surfaces at the first and second ends 34*a* and 34*b*, through which the electrical contacts 36 extend, and the respective external surfaces can be oriented substantially (within manufacturing tolerances) parallel to each other. The surface at the first end 34*a* can be defined by a mounting interface of the connector housing 34. The surfaces at the second end 34*b* can be defined by respective risers 66 as described in more detail below.

The first mating ends 32*a* are configured to physically and electrically contact respective ones of the second mating ends 36*a* so as to directly mate the first electrical contacts 32 to respective ones of the plurality of second electrical contacts 36, thereby mating the first electrical connector 22 to the second electrical connector 24. When the first and second electrical connectors 22 and 24 are mated to each other and mounted to the first and second substrates 26 and 28, respectively, the first and second substrates 26 and 28 are oriented perpendicular to each other. Thus, the electrical connector assembly 20 can be referred to as a right-angle electrical connector assembly.

The connector housing 30 includes a dielectric housing body 38 that defines the first end 30*a* and the second end 30*b* opposite the first end 30*a* along a transverse direction T. The housing body 38, and thus the connector housing 30, further defines a front end 30*c* and a rear end 30*d* opposite the front end 30*c* along a longitudinal direction L that is perpendicular to the transverse direction T. The housing body 38, and thus the connector housing 30, further first and second sides 30*e* and 30*f* that are opposite each other along a lateral direction A that is perpendicular to both the longitudinal direction L and the transverse direction T. The first electrical connector includes a first at least one electrical contact 32, such as a first plurality of electrical contacts 32, supported by the connector housing 30, and in particular supported by the housing body 38. For instance, the electrical contacts 32 can be overmolded by the connector housing 30. Alternatively, the electrical contacts 32 can be inserted into individual electrical contact channels defined by the connector housing 30.

Each of the electrical contacts 32 can define a mounting end that extends out from the first end 30*a* of the connector housing 30 and is configured to be mounted to the first substrate 26. Thus, the first end 30*a* can be referred to as a mounting interface. The mounting ends can be configured to be press-fit into the first substrate 26 so as to mount the electrical connector 22 to the first substrate 26. For instance, the mounting ends can be configured as press-fit tails. Alternatively, the mounting ends can be configured to be surface mounted to the first substrate 26 so as to mount the electrical connector 22 to the substrate 26 at the mounting interface. For instance, the mounting ends can be configured as surface mount tail or fusible elements such as solder balls. The first substrate 26 can be configured as a printed circuit board. For instance, the first substrate 26 can be configured as a daughtercard, though it should be appreciated that the first substrate can be alternatively configured as desired. For instance, the first substrate 26 can be configured as a backplane.

Each of the electrical contacts 32 can further extend out from the second end 30*b* of the connector housing 30 to a bent region 32*b*. Each of the electrical contacts 32 can further define a free mating end 32*a* that extends out with respect to the bent region 32*b* along the longitudinal direction L. For instance, the free mating end 32*a* can extend directly from the bent region 32*b*, or can extend from an intermediate portion that extends from the bent region 32*b* to the mating end 32*a*. The bent region 32*b* can be curved, angled, or define a combination of curved and angled sections. The free mating end 32*a* can be elongate along the longitudinal direction L, which can define a first direction. As described above, the first and second ends 30*a* and 30*b* are opposite each other along the transverse direction T, which can define a second direction perpendicular to the first direction. Further, as described above, the first and second sides 30*d* and 30*e* can be opposite each other along the lateral direction A, which can define a third direction perpendicular to each of the first and second directions. The electrical connector 22 is configured to be mated with a complementary electrical connector, such as the second electrical connector 24, along the longitudinal direction L. For instance, the electrical connector 22 is configured to be mated with the second electrical connector 24 in a respective forward mating direction that is along the longitudinal direction L. The front end 30*c* of the connector housing 30 is spaced from the rear end 30*d* of the connector housing 30 in the forward mating direction. The mating end 32*a* is offset from the bent region 32*b* in the mating direction.

The bent region 32*b* is disposed outside the connector housing body 38. In one example, the bent region 32*b* is disposed outside the connector housing 30. Accordingly, the second end 30*b* of the connector housing is disposed between the bent region 32*b* and the mounting end of the electrical contact 32. For instance, the bent region 32*b* can be spaced from the second end 30*b* of the connector housing 30 so as to define a gap between the mating end 32*b* and the second end 30*b* of the connector housing 30. In one example, each of the first and second ends 30*a* and 30*b* of the housing 30 defines a respective external surface of the connector housing 30, and the electrical contacts 32 extend out from the external surface of each of the first and second ends 30*a* and 30*b*, respectively. Thus, the bent region 32*b* can be spaced from the external surface of the second end 30*b* of the connector housing 30 along the transverse direction T.

The electrical contacts 32 can be substantially (for instance, within manufacturing tolerances) straight and linear along the transverse direction T along their respective lengths at least from the first end 30*a* of the connector housing 30 to the second end 30*b* of the connector housing 30. Further, the bent region 32*b* can be spaced from the mounting end along the transverse direction T. For instance, the electrical contact 32 can define a main portion that extends from the mounting end to the bent region 32*b*. The main portion can be substantially (for instance, within manufacturing tolerances) straight and linear along the transverse direction T along the transverse direction T. Thus, the bent region 32*b* can be aligned with the mounting end along the transverse direction T. The mating end 32*a* defines a tip 32*c* that is offset from the bent region 32*b* along the longitudinal direction L. In particular, the tip 32*c* is offset from the bent region 32*b* in the mating direction. Thus, the tip 32*c* can be similarly offset from the mounting end along the longitudinal direction L, and in particular in the mating direction. At least a portion of the tip 32*c* can be bent so as to be offset with respect to a remainder of the mating end 32*a* along the transverse direction T, wherein the remainder is disposed between the bent region 32*b* and the tip 32*c*. Thus, the electrical contacts 32 can be referred to as receptacle contacts. The remainder of the mating end 32*a* can be substantially (for instance, within manufacturing tolerances) linear along the longitudinal direction L.

The portion of each electrical contact 32 that extends out from the connector housing 30 can be longer in the longitudinal direction L than in the transverse direction T. For instance, in one example, the bent region 32*b* can be spaced from the second end 30*b* of the connector housing 30 a first distance along the transverse direction T, and the tip 32*c* can be spaced from the bent region 32*b* a second distance along the longitudinal direction, whereby the second distance is greater than the first distance.

In one example, the mating ends 32*a* of the electrical contacts 32 can be arranged along respective pluralities of rows 40 that each extend along the lateral direction A. In particular, the mating ends 32*a* can be arranged along the respective rows 40. The rows 40 can be spaced from each other along the transverse direction T between the first end 30*a* and the second end 30*b*. The rows 40 can further be offset from each other along the longitudinal direction L. Thus, the electrical contacts 32 whose mating ends 32*a* are arranged along the rows 40 can have different lengths than the electrical contacts 32 of others than the rows, wherein the lengths are measured from the mounting ends to the bent regions 30*b* along the transverse direction T. The bent regions 32*b* of each of the rows 40 can be aligned with each other along the lateral direction A. Further, the bent regions 32*b* of each of the rows 40 can be offset with respect to both the longitudinal direction L and the transverse direction T from the bent regions 32*b* of others of the rows 40.

The electrical contacts 32 can further be aligned along respective columns that are oriented perpendicular to the rows 40. For instance, the columns can be arranged along the transverse direction T, and spaced from each other along the lateral direction A. It should be appreciated that even though the mating ends 32*a* of the electrical contacts 32 of different rows 40 can be offset from each other along the longitudinal direction L, electrical contacts 32 whose mating ends 32*a* are aligned with the mating ends 32*a* of other rows 40 in a plane defined by the transverse direction T and the longitudinal direction L can be said to be aligned along a common one of the columns.

The rows 40 can be sequentially offset from each other in the forward direction as they are disposed adjacent each other in a direction from one of the first and second ends 30*a* and 30*b* toward the other of the first and second ends 30*a* and 30*b*. For instance, the rows 40 can be sequentially offset from each other in the forward direction as they are disposed adjacent each other in a direction from the second end 30*b* toward the first end 30*a*. Thus, the electrical contacts 32 can have lengths from the respective bent regions 32*b* to the respective mounting ends that can sequentially decrease in rows that are spaced from adjacent rows in the forward direction. The electrical contacts 32 thus define a first at least one of the electrical contacts 32 and a second at least one of the electrical contacts 32 that is spaced from the first at least one of the electrical contacts 32 in the forward direction. Each of the second at least one of the electrical contacts can have a length from the bent region 30*b* to the mounting end that is less than the corresponding length of each of the first at least one of the electrical contacts 32. The first and second at least one electrical contact can define the same length from the bent region 32*b* to the respective tip 32*c*. The first at least one of the electrical contacts 32 can include a first plurality of electrical contacts 32 arranged along a first one of the rows 40. The second at least one of the electrical contacts 32 can include a second plurality of electrical contacts 32 arranged along a second one of the rows 40.

Alternatively, the rows 40 can be sequentially offset from each other in a rearward direction opposite the forward direction as they are disposed adjacent each other in a direction from the second end 30*b* toward the first end 30*a*. Thus, the electrical contacts 32 can have lengths from the bent regions 32*b* to the mounting ends can sequentially increase in rows that are spaced from adjacent rows in the forward direction. In the orientation illustrated, the first end 30*a* can be a lower end of the connector housing 30, and the second end 30*b* can be an upper end of the connector housing 30 that is disposed above the lower end, though the orientation of the electrical connector 22 can vary during use.

The electrical contacts 32 in each of the rows 40 can be aligned with respective ones of the electrical contacts 32 in all of the other rows along respective planes that are oriented along the transverse direction T and the longitudinal direction L. Alternatively, ones of the electrical contacts in at least one of the rows 40 can be offset with respect to all other electrical contacts 32 of at least one other one of the rows 40 along the lateral direction A.

The front end 30*c* and the second end 30*b* can combine to define a shape of a staircase. For instance, the external surface of the second end 30*b* can define a plurality of flats 42 and a plurality of risers 44 that are connected between adjacent ones of the flats 42. The flats 42 are each offset from each other along the transverse direction T. The flats 42 are each further offset from each other along the longitudinal direction L. The risers 44 can extend from an inner end of one of the flats 42 to an outer end of an adjacent one of the flats 42. The outer ends of the flats 42 can be spaced from the inner ends of the flats 42 in the forward direction. The risers 44 can define an inner interface 44*a* with the inner ends of the flats 42. The risers 44 can also define an outer interface 44*b* with the outer ends of the flats 42. The electrical contacts 32 that extend out from the second end 30*b* can thus extend out from respective ones of the flats 42. For instance, the mating ends 32*a* of ones of the electrical contacts 32 that extend from a common one of the flats 42 can be arranged in a common one of the rows 40. Further, the electrical contacts 32 can be positioned such that the tips 32*c* do not extend out from the outer end of the respective flat 42 in the forward direction. For instance, the tips 32*c* can be recessed in the rearward direction from the outer end of the respective flat 42.

The flats 42 can be substantially (for instance, within manufacturing tolerances) rectangular, though it should be appreciated that the flats 42 can be alternatively shaped as desired. Further, the flats can be substantially (for instance, within manufacturing tolerances) planar along the longitudinal direction L and the lateral direction A. It should be appreciated, however, that the flats 42 can be alternatively geometrically configured as desired, and can include angled surfaces, offset surfaces, or can be nonplanar in any manner as desired. Adjacent ones of the flats 42 can be equidistantly offset from each other along the transverse direction T. Further, adjacent ones of the flats 42 can be equidistantly offset from each other along the longitudinal direction L. Similarly, the risers 44 can be substantially (for instance, within manufacturing tolerances) rectangular, though it should be appreciated that the risers 44 can be alternatively shaped as desired. Further, the risers 44 can be substantially (for instance, within manufacturing tolerances) planar along the transverse direction T and the lateral direction A, though it should be appreciated that the risers 44 can be alternatively geometrically configured as desired. Adjacent ones of the risers 44 can be equidistantly offset from each other along the transverse direction T. Further, adjacent ones of the risers 44 can be equidistantly offset from each other along the longitudinal direction L.

The electrical contacts 32 can define differential pairs or can be single ended as desired. In one example, adjacent first and second ones of the electrical contacts 32 along the lateral direction A can define respective differential signal pairs. Accordingly, the differential signal pairs can be defined by adjacent ones of the electrical contacts 32 along the respective rows. In this regard, it should be appreciated that because the electrical contacts 32 of each respective differential signal pair can define the same length from their respective mating ends to their respective mounting ends, thereby producing the same signal transmission duration and eliminating skew. Skew is a known condition that occurs when the electrical signal contacts that define a respective differential signal pair have different lengths along the respective contacts from their respective mating ends to their respective mounting ends, thereby resulting in different signal transmission durations.

Figure 4B:
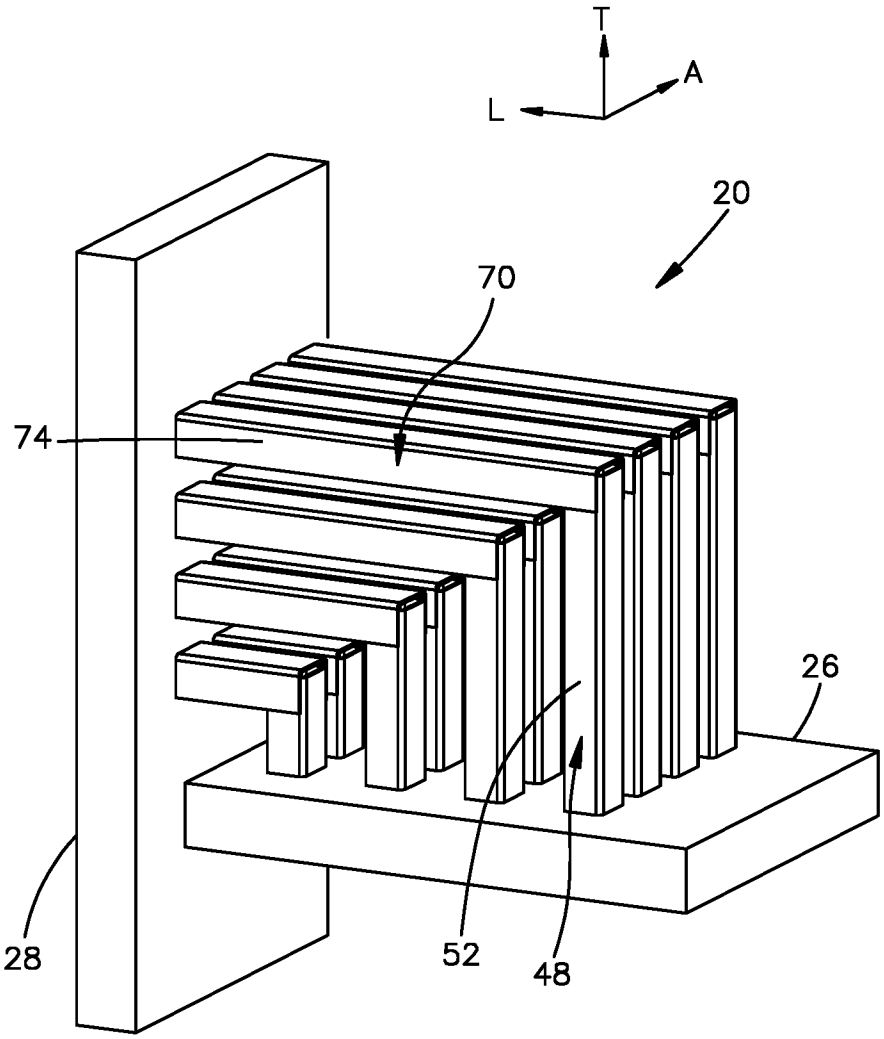
FIG. 4B is a perspective view of the electrical connector assembly illustrated in FIG. 4A, with connector housings of the first and second electrical connectors removed for the purposes of illustration.
Figure 4A:
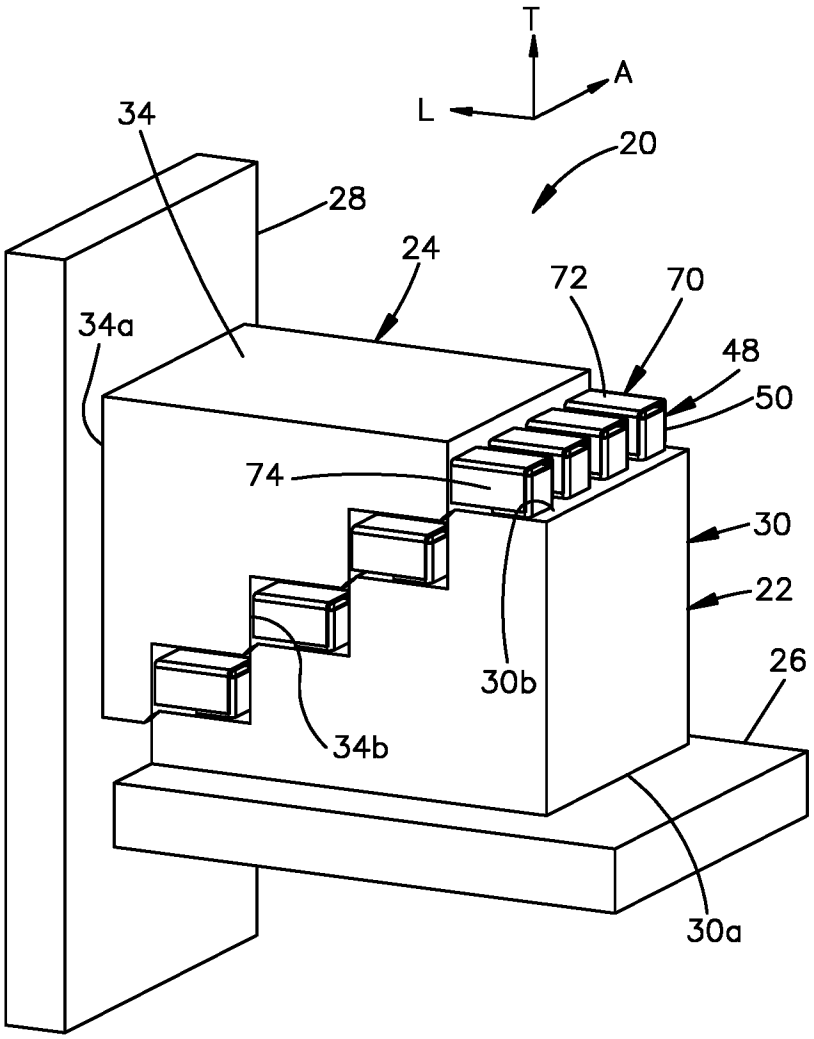
FIG. 4A is a perspective view of an electrical connector assembly including first and second electrical connectors constructed in accordance with an alternative embodiment.
Figure 4C:
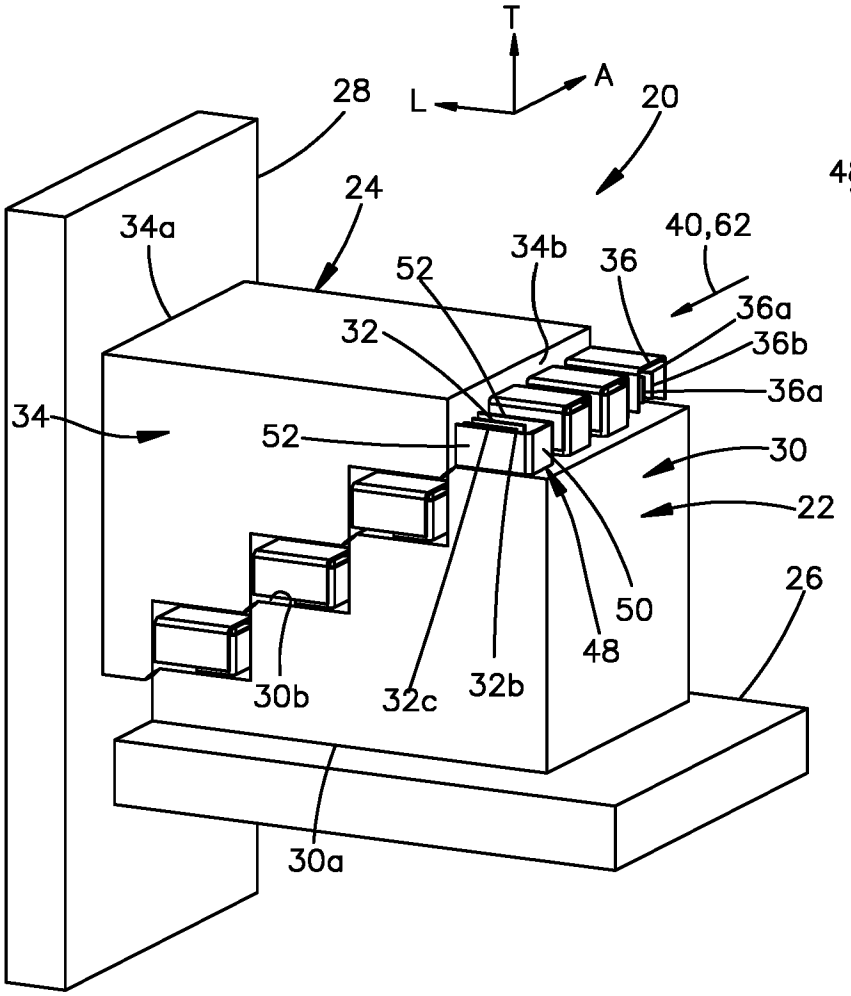
FIG. 4C is a perspective view of the electrical connector assembly illustrated in FIG. 4A, with portions removed for the purposes of illustration.

The electrical contacts 32 can be shaped and sized as desired. For instance, the electrical contacts 32 define opposed row-facing surfaces that are aligned along the respective row 40. Thus, the row-facing surfaces can be oriented along a respective plane defined by the longitudinal direction L and the transverse direction T. In one example, the electrical contacts 32 can define opposed edges and opposed broadsides that are connected between each of the opposed edges. Similarly, each of the opposed edges are connected between the opposed broadsides. The broadsides can be geometrically longer than the edges. For instance, with respect to a plane that extends through the electrical contact 32 and oriented normal to an elongate length of the electrical contact at the location where the plane extends through the electrical contact 32, the broadsides have a first length in the plane, and the edges have a second length in the plane that is less than the first length. Each of the broadsides can thus have the same first length, and each of the edges can have the same second length. The electrical contacts 32 can be oriented such that the edges face each other along the respective rows 40. Thus, the edges of the electrical contacts 32 that define the differential pairs can face each other. Accordingly, the differential pairs can be referred to as edge coupled differential pairs. Further, the row-facing surfaces can be defined by the edges. Thus, the edges can extend along respective planes defined by the longitudinal direction L and the transverse direction T. Further, the broadsides can extend along respective planes defined by the transverse direction T and the lateral direction A between the mounting ends and the bent region 32*b*. Alternatively, as illustrated in FIGS. 4A-4C, the electrical contacts 32 can be oriented such that the broadsides of the electrical contacts face each other. Thus, the differential pairs can be referred to as broadside coupled differential pairs. Further, the row-facing surfaces can be defined by the broadsides.

Referring again to FIGS. 1A-3C, the connector housing 30 can be configured to abut a connector housing of the complementary second electrical connector 24 when the first electrical connector 22 is mated with the second electrical connector 24. For instance, the connector housing 30 further comprises at least one stop member 46 that extends out from the housing body 38. The stop member 46 can be monolithic with the housing body 38, or can be attached to the housing body 38 in any suitable manner as desired. The stop member 46 defines an abutment surface that is configured to abut the complementary second electrical connector 24 when the electrical connector 22 is mated with the complementary second electrical connector 24. The stop member 46 can extend out from the housing body 38 to a free end that is disposed such that the mating end 32*a* of at least one of the electrical contacts is disposed between the free end and the second end 30*b* of the housing body 38 with respect to the transverse direction T.

For instance, the stop member 46 can extend out from a respective one of the flats 42. In one example, the stop member 46 extends along the transverse direction T in a direction from the first end 30*a* toward the second end 30*b*. The electrical connector 22 can include at least one stop member 46 that extends out from at least one of the flats 42, including a plurality of the flats 42. In one example, the electrical connector 22 can include at least one stop member 46 that extends out from each of the flats 42 that defines a row of electrical contacts 32. Alternatively, the stop members 46 can extend out from the risers 44.

Further, each of the stop members 46 can be positioned such that the stop member 46 extends out from the housing body 38 at a location such that the bent region 32*b* is disposed between the mating end 32*a* and the stop member 46 with respect to the longitudinal direction L. Thus, the stop member 46 can be adjacent at least one of the electrical contacts 32 in a rearward direction that is opposite the forward direction. In one example, a portion of each stop member 46 can be aligned with at least a portion of at least one of the electrical contacts 32 along the longitudinal direction L. For instance, the portion of each stop member 46 can be aligned with at least a portion of each electrical contact 32 of a differential signal pair along the longitudinal direction L. Alternatively, each stop member 46 can be positioned so as to be out of alignment with all electrical contacts 32 along the lateral direction A.

The electrical connector 22 can further include at least one electrically conductive ground shield 48 that at least partially surrounds the mating end 32*a* of at least one of the electrical contacts 32. The shield 48 thus defines an inner surface 48*a* that faces a direction toward the respective at least one of the electrical contacts 32, and an outer surface 48*b* opposite the inner surface that faces a direction away from the respective at least one of the electrical contacts 32. The electrically conductive ground shield 48 can be metallic. Alternatively or additionally, the electrically conductive ground shield 48 can be made from an electrically conductive plastic. Alternatively still, the electrically conductive ground shield 48 can include an electrically conductive lossy material. Alternatively still, the electrically conductive ground shield 48 can include an electrically nonconductive lossy material. The electrical connector 22 can, for instance, include a plurality of electrically conductive ground shields that each at least partially surrounds a corresponding at least one of the electrical contacts 32. Each ground shield 48 is configured to engage a complementary ground shield of the second electrical connector 24 so as to establish a ground path between the first and second electrical connectors 22 and 24. The ground shields 48 can each define mounting ends configured as described herein with respect to the mounting ends of the electrical contacts 32, and thus configured to be mounted to the first substrate 26.

In one example, each ground shield 48 is configured to engage the complementary ground shield of the second electrical connector 24 so as to substantially surround the at least one of the electrical contacts 32 along four respective orthogonal planes from the connector housing 30 to the connector housing of the second electrical connector 24. The at least one of the electrical contacts 32 can be configured as a pair of the electrical contacts 32. In one example, the pair of electrical contacts 32 can be adjacent each other along a respective one of the rows. Further, the pair of electrical contacts 32 can define a differential signal pair.

Each of the ground shields 48 can define at least a rear wall 50 that is positioned such that the main portion of the at least one electrical contact 32 and the bent region 32*b* of the electrical contact are positioned between the rear wall 50 and the mating end 32*a* of the at least one electrical contact with respect to the longitudinal direction L. Further, the rear wall 50 can be extend out from the connector housing 30 such that a respective one of the stop members 46 is disposed between the rear wall 50 and the mating end 32*a* with respect to the longitudinal direction L. In particular, the respective one of the stop members 46 can be disposed between the rear wall 50 and the bent region 32*b* with respect to the longitudinal direction L. Otherwise stated, the rear wall 50 can be spaced from the respective one of the stop members 46 in the rearward direction that is opposite the forward direction along the longitudinal direction L.

Each of the ground shields can further include at least one second wall that extends forward from the rear wall 50. The at least one second wall can be aligned with the mating end 32*a* in a plane that is oriented along each of the longitudinal direction L and the lateral direction A. For instance, the at least one second wall can be configured as a pair of opposed side walls 52 that are spaced from each other along the lateral direction A and extend forward from the rear wall 50. Thus, the ground shields 48 can be substantially (for instance, within manufacturing tolerances) U-shaped. For instance, the ground shields 38 can be substantially (for instance, within manufacturing tolerances) U-shaped along a plane defined by the longitudinal direction L and the lateral direction A. In one example, the side walls 52 can extend forward to a location forward of the tips 32*c*, even with the tips 32*c*, or recessed in the rearward direction with respect to the tips 32*c*. Each of the side walls 52 can be disposed such that the at least one mating end 32*a* is between each of the pair of side walls 52 along the lateral direction A, and aligned with a portion of each of the pair of side walls 52 along the lateral direction A. For instance, each of the side walls 52 can be disposed such that the mating ends 32*a* of a differential signal pair are disposed between each of the pair of side walls 52 along the lateral direction A, and aligned with a portion of each of the pair of side walls 52 along the lateral direction A.

Each of the ground shields 48 can extend through at least a portion of the connector housing 30 up to an entirety of the connector housing 30, such that the main portion of the at least one electrical contact 32 is disposed between and aligned with the respective side walls 52. For instance, the ground shields 48 can be overmolded by the connector housing 30. Alternatively, the ground shields 48 can be inserted into individual ground shield channels defined by the connector housing 30. Further, it should be appreciated that respective entireties of the side walls 52 and the rear wall 50 are spaced from the entirety of the respective at least one electrical contact 32. Thus, the ground shields 48 are configured to reduce electrical cross-talk between adjacent at least ones of the electrical contacts 32, which can define adjacent differential signal pairs. Each ground shield 48 can further include an upper wall 54 that extends from the rear wall 50 in the forward direction. The upper wall 54 can be located such that each of the bent region 32*b* and the mating end 32*a* are disposed between the upper wall 54 and the second end 30*b* of the connector housing 30. For instance, the upper wall 54 can be located such that each of the bent region 32*b* and the mating end 32*a* are disposed between the upper wall 54 and the respective flat through which the electrical contact 32 extends. Because the main portions of the electrical contacts 32 have a thickness in the longitudinal direction L that is less than the length of the mating ends 32*a* in the longitudinal direction L, the side walls 52 can have a first length along the longitudinal direction in the connector housing 30, and a second length outside the connector housing that is greater than the first length. The second length can be aligned with the mating ends 32*a* along the lateral direction.

As described above, each ground shield 48 is configured to contact a complementary ground shield of the second electrical connector 24, such that the ground shield and the complementary ground shield substantially surround the mating end 32*a*. Accordingly, the ground shield 48 can include a plurality of engagement members that are configured to contact the complementary ground shield. The engagement members can be configured as contact fingers 56. The contact fingers 56 can be flexible and resilient such that deflection of the fingers from an original position to a deflected position causes the fingers 56 to exert a biasing force that urges the fingers 56 to return to the original position. In one example, each of the side walls 52 can include a contact finger 56 that is configured to bear against the complementary ground shield of the second electrical connector 24 when the first and second electrical connectors are mated. In particular, the outer surfaces of the contact fingers 56 are configured to contact the complementary ground shield. Thus, the outer surface of the contact fingers 56 can flex outward when it contacts the complementary ground shield of the second electrical connector 24. Alternatively, it should be appreciated that the inner surfaces of the contact fingers 56 can be configured to contact the complementary ground shield.

The upper wall 54 can also include at least one contact finger 56 that is configured to bear against the complementary ground shield of the second electrical connector 24 when the first and second electrical connectors are mated. The at least one contact finger 56 of the upper wall 54 is disposed such that the respective mating ends 32*a* are disposed between the second end 30*b* of the connector housing and the at least one contact finger 56 of the upper wall 54 with respect to the transverse direction T. The contact finger 56 of the upper wall 54 can be referred to as an upper contact finger. In one example, the at least one contact finger 56 of the upper wall 54 can include first and second contact fingers 56 that are spaced from each other along the lateral direction A. In particular, the inner surfaces of the contact fingers 56 are configured to contact the complementary ground shield. Alternatively, it should be appreciated that the outer surfaces of the contact fingers 56 can be configured to contact the complementary ground shield.

With continuing reference to FIGS. 1A-3C, the second electrical connector 24 can include the second connector housing 34 and the second plurality of electrical contacts 36 that are supported by the connector housing 34, as described above. The second connector housing 34 includes a dielectric housing body 60 that defines the first end 34*a* and the second end 34*b* opposite the first end 34*a* along the longitudinal direction L. The first end 34*a* can be defined by a rear end of the housing body 60, and thus the housing 34. The second end 34*b* can be defined by a front end of the housing body 60, and thus the housing 34. The housing body 60, and thus the connector housing 34, further defines an upper end 34*c* and a lower end 34*d* opposite the upper end 34*c* along the transverse direction T. The housing body 60, and thus the connector housing 34, further first and second sides 34*e* and 34*f* that are opposite each other along the lateral direction A. The second electrical connector includes the second at least one electrical contact 36, such as a second plurality of electrical contacts 36, supported by the connector housing 34, and in particular supported by the housing body 60. For instance, the electrical contacts 36 can be overmolded by the connector housing 34. Alternatively, the electrical contacts 36 can be inserted into individual electrical contact channels defined by the connector housing 34.

Each of the electrical contacts 32 can define a mounting end that extends out from the first end 34*a* of the connector housing 34 and is configured to be mounted to the second substrate 28. Thus, the first end 34*a* can be referred to as a mounting interface. The mounting ends of the electrical contacts 36 can be configured to be press-fit into the second substrate 28 so as to mount the second electrical connector 24 to the second substrate 28. For instance, the mounting ends can be configured as press-fit tails. Alternatively, the mounting ends of the electrical contacts 36 can be configured to be surface mounted to the first substrate 26 so as to mount the electrical connector 24 to the substrate 28 at the mounting interface. For instance, the mounting ends can be configured as surface mount tail or fusible elements such as solder balls. The second substrate 28 can be configured as a printed circuit board. For instance, the first substrate 26 can be configured as a backplane, though it should be appreciated that the first substrate can be alternatively configured as desired. For instance, the first substrate 26 can be configured as a daughtercard.

Each of the electrical contacts 36 can further extend out from the second end 34*b* of the connector housing 34 to the mating end 36*a*. For instance, the electrical contacts 36 can extend out from the second end 34*b* along the longitudinal direction L. Thus, the electrical contacts 36 are elongate along the longitudinal direction L from the respective mounting ends to the respective mating ends 36*a*. The mating ends 36*a* are configured to physically and electrically contact respective ones of the second mating ends 32*a* so as to directly mate the second electrical contacts 36 to respective ones of the plurality of first electrical contacts 32, thereby mating the second electrical connector 24 to the first electrical connector 22. The electrical connector 22 is configured to be mated with the complementary first electrical connector 22, along the longitudinal direction L. For instance, the second electrical connector 24 is configured to be mated with the first electrical connector 22 in a respective forward mating direction that is along the longitudinal direction L. The front end 34*b* of the connector housing 34 is spaced from the rear end 34*a* of the connector housing 34 in the mating direction. The mating end 36*a* is spaced from the mounting end in the mating direction. It should be appreciated that the mating direction of the second electrical connector 24 is opposite the mating direction of the first electrical connector 22. Further, either or both of the first and second electrical connectors 22 and 24 can be moved relative to the other in its respective forward direction in order to cause the first and second electrical connector 22 and 24 to mate to each other. It should be appreciated that the first electrical connector 22 can mate with the second connector 24 by moving the first electrical connector 22 forward with respect to the second electrical connector, or by moving the second electrical connector 24 rearward with respect to the first electrical connector 22. It should be appreciated that the first electrical connector 22 can mate with the second connector 24 by moving the first electrical connector 22 in its respective forward direction with respect to the second electrical connector, or by moving the second electrical connector 24 rearward with respect to the first electrical connector 22, or both. Similarly, the second electrical connector 24 can mate with the first electrical connector 22 by moving the second electrical connector 24 in its respective forward direction with respect to the first electrical connector 22, or by moving the first electrical connector 22 rearward with respect to the second electrical connector 24, or both.

The mating end 36*a* of the electrical contacts 36 can define a free tip 36*b*. The tip 36*b* of each electrical contact can be inline with the mounting end along the longitudinal direction L. Further, the mating end 36*a* can be substantially (for instance, within manufacturing tolerances) straight and linear along the longitudinal direction L from their respective mounting ends to their respective mating ends 36*a*. In this regard, the electrical contacts 36 can be referred to as blades. Each of the first and second ends 34*a* and 34*b* of the connector housing 34 defines a respective external surface of the connector housing 34, and the electrical contacts 36 extend out from the external surface of each of the first and second ends 34*a* and 34*b*, respectively. The electrical contacts 36 can define a main portion that extends from the mounting end to the bent region, for instance, inside the connector housing 34. The main portion can be substantially (for instance, within manufacturing tolerances) straight and linear along the longitudinal direction L.

In one example, the mating ends 36*a* of the electrical contacts 36 can be arranged along respective pluralities of rows 62 that each extend along the lateral direction A. In particular, the mating ends 36*a* can be arranged along the respective rows 62. The rows 62 can be spaced from each other along the longitudinal direction L between the first end 30*a* and the second end 30*b*. The rows 62 can further be offset from each other along the transverse direction T. Thus, the electrical contacts 36 whose mating ends 36*a* are arranged along the rows 62 can have different lengths than the electrical contacts 36 of others than the rows, wherein the lengths are measured from the mounting ends to the mating ends 36*a* along the longitudinal direction L. The mating ends 36*a* of each of the rows can be aligned with each other along the lateral direction A. Further, the mating ends 36*a* of each of the rows 62 can be offset with respect to both the longitudinal direction L and the transverse direction T from the mating ends 36*a* of others of the rows 62.

The rows 62 can be sequentially offset from each other in the forward direction as they are disposed adjacent each other in a direction from upper and lower ends 34*c* and 34*d* toward the other of the upper and lower ends 34*c* and 34*d*. In one example, the rows 62 can be sequentially offset from each other in the forward direction as they are disposed adjacent each other in a direction from the lower end 34*d* toward the upper end 34*c*. Thus, the electrical contacts 36 can have lengths from the respective mating ends 36*a* to the respective mounting ends that can sequentially increase in rows that are spaced from adjacent rows in the forward direction. The electrical contacts 36 thus define a first at least one of the electrical contacts 36 and a second at least one of the electrical contacts 36 that is spaced from the first at least one of the electrical contacts 32 in the forward direction. Each of the second at least one of the electrical contacts can have a length from the mating end 36*a* to the mounting end that is greater than the corresponding length of each of the first at least one of the electrical contacts 36. The first at least one of the electrical contacts 36 can include a first plurality of electrical contacts 36 arranged along a first one of the rows 62. The second at least one of the electrical contacts 36 can include a second plurality of electrical contacts 36 arranged along a second one of the rows 62. Alternatively, the rows 62 can be sequentially offset from each other in a rearward direction opposite the forward direction as they are disposed adjacent each other in a direction from the lower end 34*d* toward the upper end 34*c*.

The electrical contacts 36 in each of the rows 62 can be aligned with respective ones of the electrical contacts 36 in all of the other rows 62 along respective planes that are oriented along the transverse direction T and the longitudinal direction L. Alternatively, ones of the electrical contacts 36 in at least one of the rows 62 can be offset with respect to all other electrical contacts 36 of at least one other one of the rows 62 along the lateral direction A.

The front end 34*b* of the connector housing 34 and the lower end 34*d* of the connector housing 34 can combine to define a shape of a staircase. For instance, the connector housing 34 can define a plurality of flats 64, and risers 66 that are connected between adjacent ones of the flats 64 at the front end 34*b*. For instance, the flats can be defined by the lower end 34*d* at the front end of the connector housing 34 in its illustrated orientation, though it should be appreciated that the orientation of the connector housing 34 can change during use. The risers 66 can be defined by the front end 34*b* of the connector housing 34. Adjacent ones of the risers 66 can be offset from each other along both the longitudinal direction L and the transverse direction T. Similarly, the flats 64 are each offset from each other along both the longitudinal direction L and the transverse direction T. The flats 64 can face a first direction along the transverse direction T, and the flats 42 of the first connector housing 30 can face a second direction along the transverse direction T that is opposite the first direction along the transverse direction T when the first and second electrical connectors 22 and 24 are mated to each other.

The risers 66 can extend from an inner end of one of the flats 64 to an outer end of an adjacent one of the flats 64. The outer ends of the flats 64 can be spaced from the inner ends of the flats 64 in the forward direction. The risers 66 can define an inner interface 66*a* with the inner ends of the flats 64. The risers 66 can also define an outer interface 66*b* with the outer ends of the flats 64. The outer interfaces 66*b* can be diagonally adjacent to the outer interfaces 44*b* of the first connector housing 30 when the first and second electrical connectors 22 and 24 are mated with each other. Thus, the outer interfaces 66*b* and 44*b* can be spaced from each other along a direction that includes both the longitudinal direction L and the transverse direction T as directional components.

The electrical contacts 32 that extend out from the second end 34*b* of the connector housing 34 can extend out from respective ones of the risers 66. For instance, the mating ends 36*a* of ones of the electrical contacts 36 that extend from a common one of the risers can be arranged in a common one of the rows 62. Further, the electrical contacts 36 can be positioned such that the tips 36*b* do not extend out from the adjacent forwardly spaced one of the risers 66 in the forward direction. For instance, the tips 36*b* can be recessed in the rearward direction from the outer end of the adjacent forwardly spaced one of the risers 66.

The flats 64 can be substantially (for instance, within manufacturing tolerances) rectangular, though it should be appreciated that the flats 64 can be alternatively shaped as desired. Further, the flats can be substantially (for instance, within manufacturing tolerances) planar along the longitudinal direction L and the lateral direction A. It should be appreciated, however, that the flats 64 can be alternatively geometrically configured as desired, and can include angled surfaces, offset surfaces, or can be nonplanar in any manner as desired. Adjacent ones of the flats 64 can be equidistantly offset from each other along the transverse direction T. Further, adjacent ones of the flats 64 can be equidistantly offset from each other along the longitudinal direction L. Similarly, the risers 66 can be substantially (for instance, within manufacturing tolerances) rectangular, though it should be appreciated that the risers 66 can be alternatively shaped as desired. Further, the risers 66 can be substantially (for instance, within manufacturing tolerances) planar along the transverse direction T and the lateral direction A, though it should be appreciated that the risers 66 can be alternatively geometrically configured as desired. Adjacent ones of the risers 66 can be equidistantly offset from each other along the transverse direction T. Further, adjacent ones of the risers 66 can be equidistantly offset from each other along the longitudinal direction L. Ones of the risers 66 that are sequential along the transverse direction can be offset from each other in the forward direction. For instance, ones of the risers 66 that are sequentially adjacent along the transverse direction T in a direction from the lower end 34*d* toward the upper end 34*c* can be offset from each other in the forward direction. Alternatively, ones of the risers 66 that are sequentially adjacent along the transverse direction T in a direction from the lower end 34*d* toward the upper end 34*c* can be offset from each other in the rearward direction.

The electrical contacts 36 can define differential pairs or can be single ended as desired. In one example, adjacent first and second ones of the electrical contacts 36 along the lateral direction A can define respective differential signal pairs. Accordingly, the differential signal pairs can be defined by adjacent ones of the electrical contacts 36 along the respective rows 62. The electrical contacts 36 can be shaped and sized as desired. For instance, the electrical contacts 36 define opposed row-facing surfaces that are aligned along the respective row 62. Thus, the row-facing surfaces can be oriented along a respective plane defined by the longitudinal direction L and the transverse direction T.

In one example, the electrical contacts 36 can define opposed edges and opposed broadsides that are connected between each of the opposed edges. Similarly, each of the opposed edges are connected between the opposed broadsides. The broadsides can be geometrically longer than the edges. For instance, with respect to a plane that extends through the electrical contact 36 and oriented normal to the electrical contact at the location where the plane extends through the electrical contact 36, the broadsides have a first length in the plane, and the edges have a second length in the plane that is less than the first length. Each of the broadsides can thus have the same first length, and each of the edges can have the same second length. The electrical contacts 36 can be oriented such that the edges face each other along the respective rows 62. Thus, the edges of the electrical contacts 36 that define the differential pairs can face each other. Accordingly, the differential pairs can be referred to as edge coupled differential pairs. Further, the row-facing surfaces can be defined by the edges. Thus, the edges of the electrical contacts 36 can extend along respective planes defined by the longitudinal direction L and the transverse direction T. Further, the broadsides can extend along respective planes defined by the longitudinal direction L and the lateral direction A. Alternatively, as illustrated in FIGS. 4A-4C, the electrical contacts 36 can be oriented such that the broadsides of the electrical contacts face each other. Thus, the differential pairs can be referred to as broadside coupled differential pairs. Further, the row-facing surfaces can be defined by the broadsides.

With continuing reference to FIGS. 1A-3C, the connector housing 34 can be configured to abut the connector housing 30 of the complementary first electrical connector 22 when the first electrical connector 22 is mated with the second electrical connector 24. For instance, the connector housing 34 further comprises at least one stop member 68 that extends out from the housing body 60. The stop member 68 can be monolithic with the housing body 60, or can be attached to the housing body 60 in any suitable manner as desired. The stop member 68 defines an abutment surface that is configured to abut the complementary first electrical connector 22 when the second electrical connector 24 is mated with the complementary first electrical connector 22. In particular, the stop members 46 and 68 can abut each other when the first and second electrical connectors 22 and 24 are fully mated to each other. The stop member 68 can extend out from the housing body 60 to a free end that is disposed such that the stop member 68 is disposed between the mating end 36*a* of at least one of the electrical contacts 36 and the corresponding flat 64 with respect to the transverse direction T. The corresponding flat 64 can be defined by the flat that defines an inner interface 66*a* with the respective riser 66.

For instance, the stop member 68 can extend out from a respective one of the risers 66. In one example, the stop member 68 extends along the longitudinal direction L in the forward direction from the second end 34*b* toward the first end 34*a*. The electrical connector 24 can include at least one stop member 68 that extends out from at least one of the risers 66, including a plurality of the risers 66. In one example, the electrical connector 24 can include at least one stop member 68 that extends out from each of the risers 66 that defines a row of electrical contacts 36. Alternatively, the stop members 68 can extend out from ones of the flats 64. In one example, a portion of each stop member 68 can be aligned with at least a portion of at least one of the electrical contacts 36 along the transverse direction T. For instance, the portion of each stop member 68 can be aligned with at least a portion of each electrical contact 36 of a differential signal pair along the transverse direction T. Alternatively, each stop member 68 can be positioned so as to be out of alignment with all electrical contacts 36 along the lateral direction A.

The second electrical connector 24 can further include at least one electrically conductive ground shield 70 that is configured to engage a complementary one of the ground shields 48 of the first electrical connector 22 so as to establish a ground path between the first and second electrical connectors 22 and 24. The ground shields 70 can each define mounting ends configured as described herein with respect to the mounting ends of the electrical contacts 36, and thus configured to be mounted to the second substrate 28. For instance, the ground shields 70 can at least partially surround the mating end 36*a* of at least one of the electrical contacts 36. The shield 70 thus defines an inner surface 70*a* that faces a direction toward the respective at least one of the electrical contacts 36, and an outer surface 70*b* opposite the inner surface that faces a direction away from the respective at least one of the electrical contacts 36. The electrically conductive ground shield 70 can be metallic. Alternatively or additionally, the electrically conductive ground shield 70 can be made from an electrically conductive plastic. Alternatively still, the electrically conductive ground shield 70 can include an electrically conductive lossy material. Alternatively still, the electrically conductive ground shield 70 can include an electrically nonconductive lossy material. The electrical connector 24 can, for instance, include a plurality of electrically conductive ground shields 70 that each at least partially surrounds a corresponding at least one of the electrical contacts 36. Each ground shield 70 is configured to engage a complementary one of the ground shields 48 of the first electrical connector 22 so as to substantially surround the at least one of the electrical contacts 36 along four respective orthogonal planes from the first connector housing 30 to the second connector housing 34. The at least one of the electrical contacts 36 can be configured as a pair of the electrical contacts 36. In one example, the pair of electrical contacts 36 can be adjacent each other along a respective one of the rows 62. Further, the pair of electrical contacts 36 can define a differential signal pair.

Each of the ground shields 70 an upper wall 72 and opposed side walls 74 that extend out from the upper wall. Thus, the ground shields 70 can be substantially (for instance, within manufacturing tolerances) U-shaped. For instance, the ground shields 70 can be substantially (for instance, within manufacturing tolerances) U-shaped along a plane defined by the transverse direction T and the lateral direction A. The ground shields 70 can be positioned such that the respective at least one of the mating ends 36*a* disposed between the side walls 74 and aligned with each of the side walls 74 along the lateral direction A. For instance, the ground shields 70 can be positioned such that the mating ends 36*a* of a differential signal pair are disposed between the side walls 74 and aligned with each of the side walls 74 along the lateral direction A. In one example, the upper wall 72 and the side walls 74 can extend forward to a location forward of the tips 36*b*, even with the tips 36*b*, or recessed in the rearward direction with respect to the tips 36*b*. The stop member 68 can be positioned between the upper wall 72 and the mating end 36*a* with respect to the transverse direction T.

Each of the ground shields 70 can extend through at least a portion of the connector housing 34 up to an entirety of the connector housing 34, such that the main portion of the at least one electrical contact 36 is disposed between and aligned with the respective side walls 74 along the lateral direction. For instance, the ground shields 70 can be overmolded by the connector housing 34. Alternatively, the ground shields 70 can be inserted into individual ground shield channels defined by the connector housing 34. Further, it should be appreciated that respective entireties of the upper wall 72 and the side walls 52 are spaced from the entirety of the respective at least one electrical contact 36. Thus, the ground shields 70 are configured to reduce electrical cross-talk between adjacent at least ones of the electrical contacts 36, which can define adjacent differential signal pairs.

As described above, each ground shield 70 is configured to contact a complementary ground shield 48 of the first electrical connector 24 when the first and second electrical connectors 22 and 24 are mated to each other, such that the ground shield 70 and the complementary ground shield 48 substantially surround the mating ends 32*a* and 36*a*. Each of the side walls 74 can define lower ends that are configured to face the connector housing 30 when the first and second electrical connectors 22 and 24 are mated to each other. For instance, the lower ends can abut the connector housing 30, such as the flats 42, when the first and second electrical connectors 22 and 24 are mated to each other. The ground shields 48 and 70 are configured to physically and electrically attach to each other. For instance, a first portion of the first ground shield 48 can be disposed between a first portion of the second ground shield 70 and the respective mated electrical contacts 32 and 36. Further, second a portion of the second ground shield 70 can be disposed between a second portion of the first ground shield 48 and the mated electrical contacts 32 and 36. In one example, the first portion of the first ground shield 48 is defined by the side walls 52, and the first portion of the ground shield 70 is defined by the side walls 74. The second portion of the ground shield 70 can be defined by the upper wall 72, and the second portion of the ground shield 48 can be defined by the upper wall 54. The upper wall 72 of the ground shield 70 can be substantially continuous from one of the side walls 74 to the other of the side walls 74 along the lateral direction A.

The ground shield 70 can include a plurality of engagement members that are configured to contact the complementary ground shield. The engagement members can be configured as contact fingers 76. The contact fingers 76 can be flexible and resilient such that deflection of the fingers from an original position to a deflected position causes the fingers 76 to exert a biasing force that urges the fingers 76 to return to the original position. In one example, each of the side walls 74 can include a contact finger 76 that is configured to bear against a complementary one of the side walls 52 of the ground shield 48. For instance, the contact fingers 76 are configured to bear against the outer surfaces of the respective ones of the side walls 52. The contact fingers 56 of the side walls 52 are configured to contact respective ones of the side walls 74. For instance, the contact fingers 56 of the side walls 52 are configured to bear against respective inner surfaces of the respective ones of the side walls 74.

The upper wall 72 is also configured to contact the complementary ground shield 48 of the first electrical connector 22 when the first and second electrical connectors are mated to each other. For instance, the at least one contact finger 56 of the upper wall 54 of the first ground shield is configured to bear against the outer surface of the upper wall 72 of the second ground shield 70. Thus, the ground shields 48 and 70 can be configured to physically contact each other at six separate contact locations, though it should be appreciated that the ground shields can be configured to contact each other at any number of contact locations as desired. In one example, the ground shields 48 and 70 contact each other at their respective side walls and their respective top walls.

Referring now to FIGS. 4A-4C, it should be appreciated that one or both of the first and second electrical connectors 22 and 24 can be constructed in accordance with any suitable alternative embodiment as desired. For instance, each of the first plurality of electrical contacts 32 can be devoid of the bent region 32*b*. Accordingly, each of the first plurality of electrical contacts 32 can extend from the second end 30*b* of the connector housing along the transverse direction T so as to define the mating end 32*a*. The mating end 32*a* can terminate at the tip 32*c* as described above. Accordingly, the electrical contacts 32 can be substantially (for instance, within manufacturing tolerances) straight and linear along the transverse direction T along their respective lengths at least from the first end 30*a* of the connector housing 30 to the second end 30*b* of the connector housing 30. Further, the electrical contacts 32 can be substantially (for instance, within manufacturing tolerances) straight and linear along the transverse direction along their respective lengths at least from the respective mounting ends to the second end 30*b* of the connector housing 30. Further still, the electrical contacts 32 can be substantially (for instance, within manufacturing tolerances) straight and linear along the transverse direction T along their respective lengths at least from the respective tip 32*c* to the second end 30*b* of the connector housing. Further still, the electrical contacts 32 can be substantially (for instance, within manufacturing tolerances) straight and linear along the transverse direction T along their respective lengths at least from the respective tip 32*c* to the first end 30*a* of the connector housing 30. Thus, it should be appreciated that the electrical contacts 32 can be substantially (for instance, within manufacturing tolerances) straight and linear along the transverse direction T along their respective lengths at least from the respective tip 32*c* to the respective mounting end. Otherwise stated, the mating ends 32*a* can be inline with the respective mounting ends, for instance along the transverse direction T.

As described above, the electrical contacts 32 can define opposed edges and opposed broadsides. The broadsides are connected between each of the opposed edges, and each of the opposed edges are similarly connected between the opposed broadsides. The broadsides can be geometrically longer than the edges. For instance, with respect to a plane that extends through the electrical contact 32 and oriented normal to an elongate length of the electrical contact at the location where the plane extends through the electrical contact 32, the broadsides have a first length in the plane, and the edges have a second length in the plane that is less than the first length. Each of the broadsides can thus have the same first length, and each of the edges can have the same second length. The electrical contacts 32 can be oriented such that the broadsides face each other along the respective rows 40. Thus, the broadsides of the electrical contacts 32 that define the differential pairs can face each other. Accordingly, the differential pairs can be referred to as broadside coupled differential pairs. Further, the row-facing surfaces can be defined by the broadsides at the mating ends 32*a*. Further still, the row-facing surfaces can be defined by the broadsides along an entirety of the length of each of the respective electrical contacts 32 from the mounting ends to the mating ends 32*a*. The mating ends 32*a* of each differential signal pair can be spaced from each other a first distance along the lateral direction A.

As described above, the ground shields 48 can be constructed substantially as described above. For instance, each ground shield 48 can define at least the rear wall 50 that is positioned such that the mating end 32*a* of the at least one electrical contact 32 that is at least partially surrounded by the ground shield 48 can be spaced from the rear wall 50 in the forward mating direction. Each of the ground shields 48 can further include at least one second wall that extends forward from the rear wall 50. The at least one second wall can be aligned with the mating end 32*a* in a plane that is oriented along each of the longitudinal direction L and the lateral direction A. For instance, the at least one second wall can be configured as a pair of opposed side walls 52 that are spaced from each other along the lateral direction A and extend forward from the rear wall 50. Thus, the ground shields 48 can be substantially (for instance, within manufacturing tolerances) U-shaped. For instance, the ground shields 48 can be substantially (for instance, within manufacturing tolerances) U-shaped along a plane defined by the longitudinal direction L and the lateral direction A. The opposed side walls 52 can be spaced from each other a first distance along the lateral direction A.

In one example, the side walls 52 can have a height from the connector housing 30 along the transverse direction T that is equal to a height of the at least partially surrounded tip 30*c* from the connector housing 30. Alternatively, the height of the side walls 52 can be greater than the height of the at least partially surrounded tip 30*c*. Alternatively still, the height of the side walls 52 can be slightly less than the height of the at least partially surrounded tip 30*c*, so long as the shields 48 and 70 combine to provide effective shielding of the at least partially sounded mating ends 32*a* of the differential signal pair. The rear wall 50 can have a height from the connector housing 30 along the transverse direction T that can be substantially equal to the height of the side walls 52. Alternatively, the height of the rear wall 50 can be different than the height of the side walls 52.

Each of the side walls 52 can be disposed such that the mating end 32*a* is between each of the pair of side walls 52 along the lateral direction A, and aligned with a portion of each of the pair of side walls 52 along the lateral direction A. For instance, each of the side walls 52 can be disposed such that the mating ends 32*a* of a differential signal pair are disposed between each of the pair of side walls 52 along the lateral direction A, and aligned with a portion of each of the pair of side walls 52 along the lateral direction A. The ground shields 48 can define an open upper end. Alternatively, the ground shields can include the upper wall 48 that covers the respective at least one mating end 32*a* as described above. Further, the ground shields 48 can include the contact fingers 56 as described above, or can be devoid of one or more up to all of the contact fingers 56 described above. For instance, the ground shields 48 can define a contact finger at each of the side walls 52.

With continuing reference to FIGS. 4A-4C, and as described above, each of the second plurality of electrical contacts 36 can define opposed edges and opposed broadsides. The broadsides are connected between each of the opposed edges, and each of the opposed edges are similarly connected between the opposed broadsides. The broadsides can be geometrically longer than the edges. For instance, with respect to a plane that extends through the electrical contact 36 and oriented normal to an elongate length of the electrical contact at the location where the plane extends through the electrical contact 36, the broadsides have a first length in the plane, and the edges have a second length in the plane that is less than the first length. Each of the broadsides can thus have the same first length, and each of the edges can have the same second length. The electrical contacts 36 can be oriented such that the broadsides face each other along the respective rows 62. Thus, the broadsides of the electrical contacts 36 that define the differential pairs can face each other. Accordingly, the differential pairs can be referred to as broadside coupled differential pairs. Further, the row-facing surfaces can be defined by the broadsides at the mating ends 36*a*. Further still, the row-facing surfaces can be defined by the broadsides along an entirety of the length of each of the respective electrical contacts 36 from the mounting ends to the mating ends 36*a*. The mating ends 36*a* of each differential signal pair can be spaced from each other a first distance along the lateral direction A.

The mating ends 36*a* of the differential signal pairs can be spaced from each other a second distance along the lateral direction A. The second distance can be different than the first distance that the mating ends 32*a* of the differential signal pairs are spaced from each other along the lateral direction A described above. In one example, the second distance is less than the first distance such that the mating ends 36*a* fit inside the mating ends 32*a* so as to mate the respective electrical contacts 32 and 36 of the respective differential signal pairs to each other. Thus, respective outer surfaces of the mating ends 36*a* contact respective inner surfaces of the mating ends 32*a* of each of the respective differential signal pairs. The inner surfaces of the mating ends 32*a* of each respective differential pair face each other. The outer surfaces of the mating ends 32*a* of each respective differential pair are opposite the inner surfaces. Similarly, the inner surfaces of the mating ends 36*a* of each respective differential pair face each other. The outer surfaces of the mating ends 36*a* of each respective differential pair are opposite the inner surfaces.

Alternatively, the second distance is greater than the first distance such that the mating ends 32*a* fit inside the mating ends 36*a* so as to mate the respective electrical contacts 32 and 36 of the respective differential signal pairs to each other. Thus, the respective inner surfaces of the mating ends 36*a* contact the respective outer surfaces of the mating ends 32*a* of each of the respective differential signal pairs. Alternatively still, the second distance is substantially (for instance, within manufacturing tolerances) equal to the first distance. Accordingly, the inner surface of a first one of the mating ends 32*a* of a respective differential signal pair contacts the outer surface of a first one of the mating ends 36*a* of a respective differential signal pair, and the outer surface of a second one of the mating ends 32*a* of the respective differential signal pair contacts the inner surface of a second one of the mating ends 36*a* of the respective differential signal pair, so as to mate the electrical contacts 32 and 36 of the respective differential signal pairs to each other.

The ground shields 70 can be constructed substantially as described above. The side walls 74 can be spaced apart a second distance along the lateral direction A. The second distance can be different than the first distance that the side walls 52 of the ground shields 48 are spaced from each other along the lateral direction A described above. In one example, the second distance is greater than the first distance such that the side walls 52 fit inside the side walls 74 so as to mate the ground shields 48 and 70 to each other. Thus, respective outer surfaces of the side walls 52 contact respective inner surfaces of the side walls 74 of each of the respective ground shields 48 and 70. The side walls 52 of each ground shield 48 define respective inner surfaces that face each other, and outer surfaces opposite the inner surfaces. Similarly, the side walls 70 of each ground shield 70 define respective inner surfaces that face each other, and outer surfaces opposite the inner surfaces.

Alternatively, the second distance is less than the first distance such that the side walls 74 fit inside the side walls 52 so as to mate the respective ground shields 70 and 48 to each other. Thus, the respective inner surfaces of the side walls 52 contact the respective outer surfaces of the side walls 74 of each of the respective ground shields 48 and 70. Alternatively still, the second distance is substantially (for instance, within manufacturing tolerances) equal to the first distance. Accordingly, the inner surface of a first one of the side walls 52 of the ground shield 48 contacts the outer surface of a first one of the side walls 74 of the ground shield 70, and the outer surface of a second one of the side walls 52 of the ground shield 48 contacts the inner surface of a second one of the side walls 74 of the respective ground shield 70, so as to mate the ground shields 48 and 70 to each other.

The ground shield 70 can include the contact fingers 76 as described above, or can be devoid of one or more up to all of the contact fingers 76. For instance, if the ground shield 48 is devoid of the upper wall 54, then the ground shield 70 can be devoid of the upper contact fingers 76. The side walls 74 can include respective contact fingers 76 that are configured to contact respective ones of the side walls 52 of the ground shields 48 when the ground shields 48 and 70 are mated to each other.

As described above, the electrical connector assembly 20 can include the first electrical connector 22, and the second electrical connector 24, wherein the first plurality of electrical contacts 32 are configured to directly mate with respective ones of the second plurality of electrical contacts 36 such that the first ends of the first and second connector housings are perpendicular to each other. Thus, the electrical connector assembly 20 can be referred to as a right-angle electrical connector assembly 20. The first end of the first electrical connector 22 can define a mounting interface that is configured to face the first substrate when the first electrical connector 22 is mounted to the first substrate. Similarly, the first end of the second electrical connector 24 can define a mounting interface that is configured to face the second substrate when the second electrical connector 24 is mounted to the second substrate.

It should be further appreciated that a method can be provided for placing the first substrate 26 in electrical communication with the second substrate 28. The method can include the steps of mounting the first electrical connector 22 to the first substrate 26, mounting the second electrical connector 24 to the second substrate 28, and directly mating the first electrical contacts 32 to respective ones of the second electrical contacts 36, wherein the first electrical contacts 32 are vertical contacts, and the second electrical contacts 36 are vertical contacts. The mating step can cause the first and second substrates 26 and 28 to be oriented perpendicular to each other.

A method can further be provided for mating first and second electrical connectors 22 and 24 to each other. The method can include the step of physically and electrically contacting the first plurality of vertical electrical contacts 32 of the first electrical connector 22 to respective ones of the second plurality of vertical electrical contacts 36 of the second electrical connector 24 such that the mounting interface 30*a* of the first electrical connector 22 is oriented along a first plane, a mounting interface 34*a* of the second electrical connector 24 is oriented along a second plane, and the first plane is perpendicular to the second plane.

A method can further include teaching any one or more up to all of the above method steps, and selling or offering to sale to the third party any one or more up to all of the first electrical connector 22, the second electrical connector 24, the first substrate 26, and the second substrate 28.

Figure 5A:
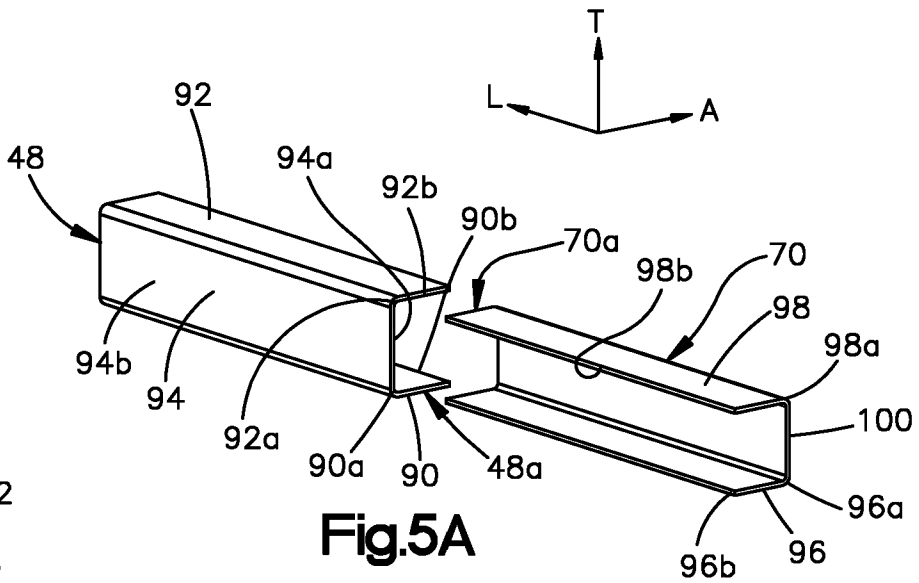
FIG. 5A is an exploded perspective view of first and second ground shields of first and second electrical connectors aligned to be mated in accordance with another embodiment.
Figure 5B:
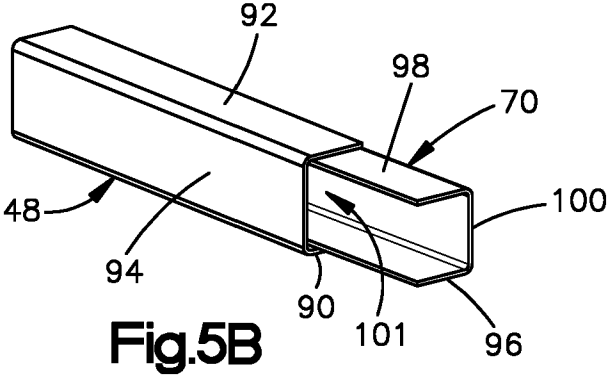
FIG. 5B is a perspective view of first and second ground shields illustrated in FIG. 5A, shown mated to each other.

Referring now to FIGS. 5A-5B, it should be appreciated that the first electrically conductive ground shield 48 and the second electrically conductive ground shield 70 can be constructed in accordance with any suitable alternative embodiment as desired. For instance, the first electrically conductive ground shield 48 can be substantially C-shaped. Similarly, the second electrically conductive ground shield 70 can be substantially C-shaped.

Thus, the first electrically conductive ground shield 48 can include a first lower wall 90, a first upper wall 92 opposite the first lower wall 90, and a first side wall 94 that is connected between the first lower wall 90 and the first upper wall 92. The first lower wall 90 can be parallel with the first upper wall 92. The first lower wall 90 can be planar along a plane that is defined by the lateral direction A and the longitudinal direction L. Similarly, the first upper wall 92 can be planar along a plane that is defined by the lateral direction A and the longitudinal direction L. The first side wall 94 can be oriented perpendicular with respect to each of the first lower wall 90 and the first upper wall 92.

For instance, the first side wall 94 can extend between respective lateral ends of the first lower wall 90 and the first upper wall 92. The first lower wall 90 can define a first inner lateral end 90*a* and a first outer lateral end 90*b* opposite the first lateral inner end 90*a* along the lateral direction A. The upper wall 92 can define a first inner lateral end 92*a* and a first outer lateral end 92*b* opposite the first lateral inner end 92*a* along the lateral direction A. The first side wall 94 can extend from the first inner lateral end 90*a* to the first lateral inner end 92*a*. Thus, the first side wall 94 can be planar along a plane that is defined by the transverse direction T and the longitudinal direction L. The first side wall 94 can define a first inner surface 94*a* that faces a direction in which the lower and upper walls 90 and 92 extend from the side wall 94. The first side wall 94 can define a second outer surface 94*b* that faces opposite the first surface 94*a*. Further, the first electrically conductive ground shield 48 can define a first outer longitudinal end 48*a*.

Figure 5C:
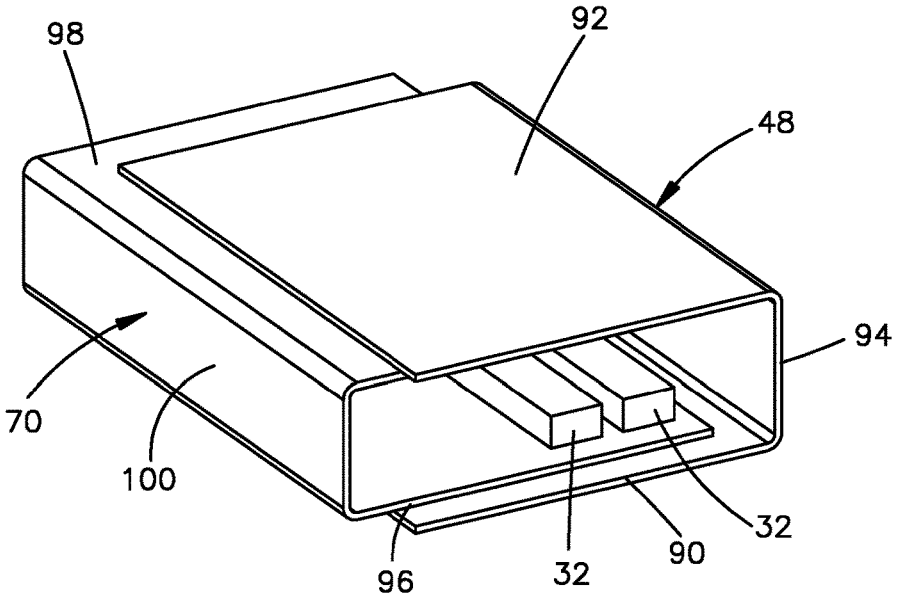
FIG. 5C is a perspective view of first and second ground shields similar to the first and second ground shields illustrated in FIG. 5B, but shown mated and offset with respect to each other.
Figure 5D:
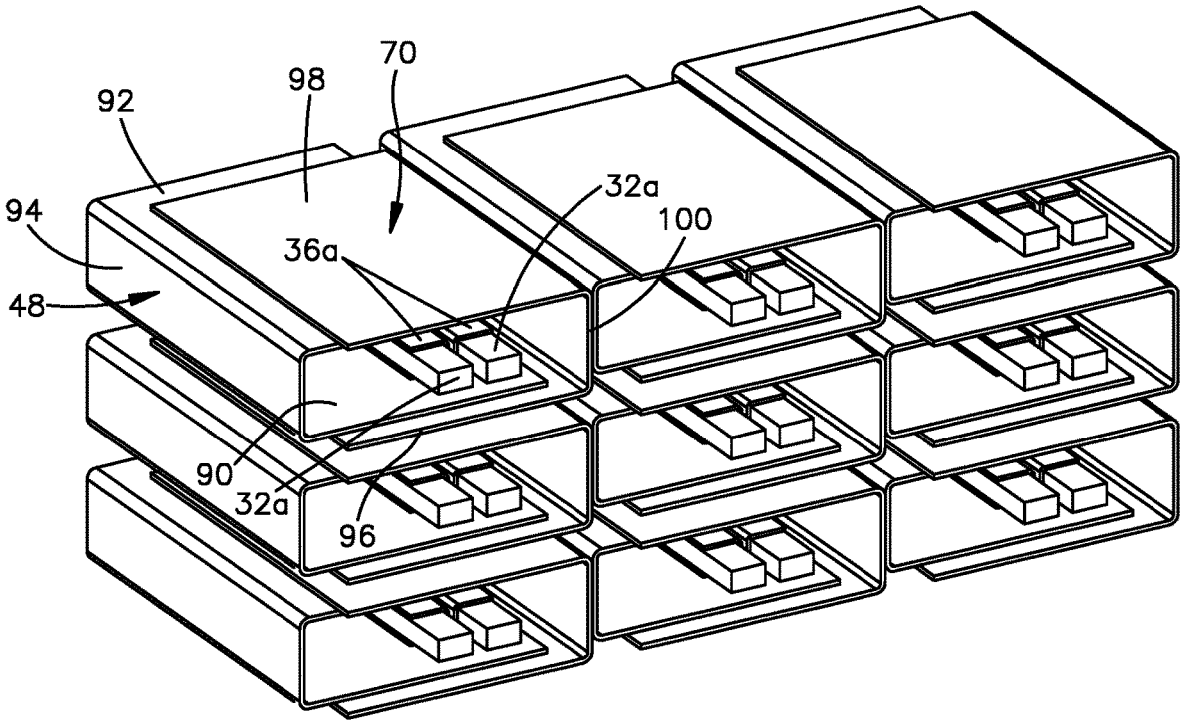
FIG. 5D is a perspective view of an array of the first and second ground shields mated as illustrated in FIG. 5C, each shown surrounding respective differential signal pairs.
Figure 5E:
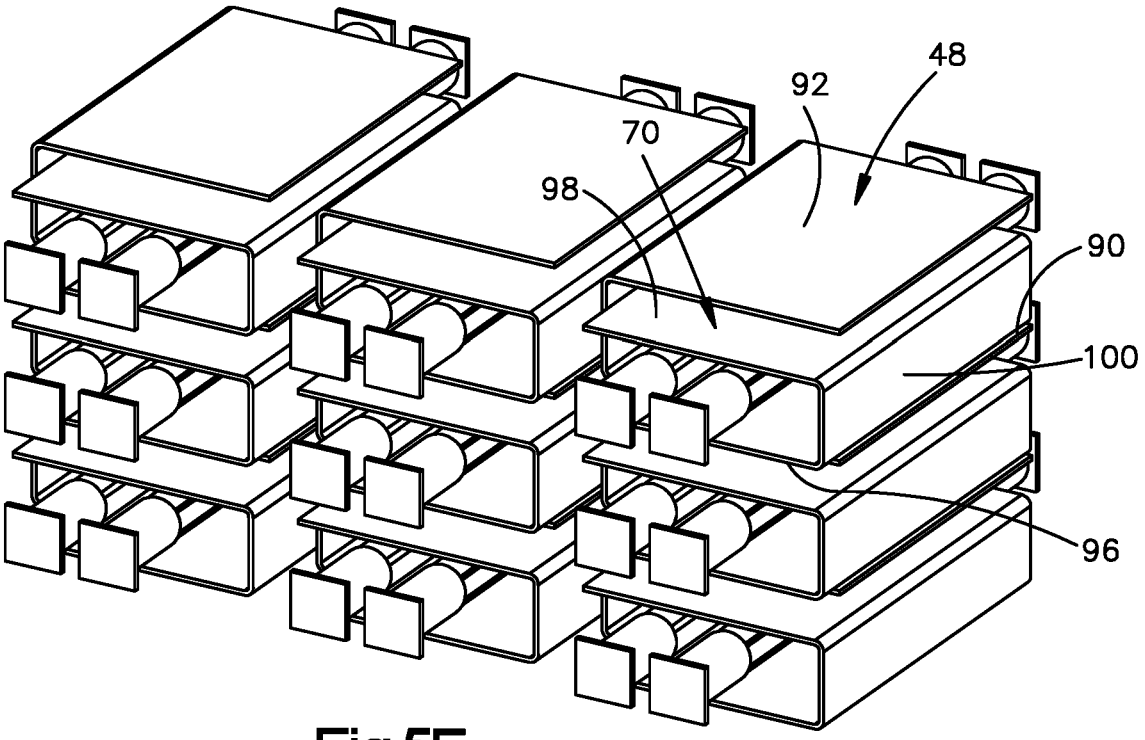
FIG. 5E is a perspective view showing is a perspective view of an array of the first and second ground shields of first and second electrical connectors mated of FIG. 5C, each shown surrounding respective partially mated differential signal pairs.
Figure 5F:
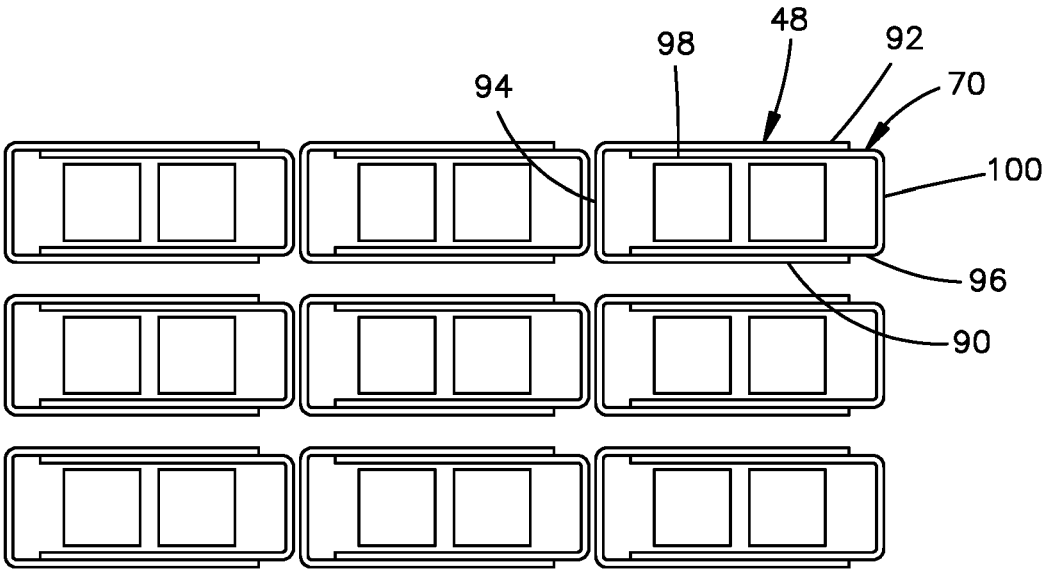
FIG. 5F is a schematic end elevation view of the array illustrated in FIG. 5E.

Each of the first lower wall 90, the first upper wall 92, and the first side wall 94 can define a respective distance along a first plane that intersects the first ground shield 48 and is oriented along the transverse direction T and the lateral direction A. The distance of the first lower wall 90 and the first upper wall 92 can be equal to each other. Alternatively, the distance of the first lower wall 90 and the first upper wall 92 can be different than each other. The distance of the first side wall 94 can be equal to, greater than, or less than either or both of the distance of the first lower wall 90 and the distance of the first upper wall 92. For instance, as illustrated in FIGS. 5C-5D, the distance of the first side wall 94 can be less than each of the distance of the first lower wall 90 and the distance of the first upper wall 92.

Similarly, the second electrically conductive ground shield 70 can include a second lower wall 96, a second upper wall 98 opposite the second lower wall 96, and a second side wall 100 that is connected between the second lower wall 96 and the second upper wall 98. The second lower wall 96 can be parallel with the second upper wall 98. The second lower wall 96 can be planar along a plane that is defined by the lateral direction A and the longitudinal direction L. Similarly, the second upper wall 98 can be planar along a plane that is defined by the lateral direction A and the longitudinal direction L. The second side wall 100 can be oriented perpendicular with respect to each of the second lower wall 96 and the second upper wall 98.

For instance, the second side wall 100 can extend between respective lateral ends of the second lower wall 96 and the second upper wall 98. The second lower wall 96 can define a second inner lateral end 96*a* and a second outer lateral end 96*b* opposite the second lateral inner end 96*a* along the lateral direction A. The second upper wall 98 can define a second inner lateral end 98*a* and a second outer lateral end 98*b* opposite the second lateral inner end 98*a* along the lateral direction A. The second side wall 100 can extend from the second inner lateral end 96*a* to the second lateral inner end 98*a*. The second side wall 100 can extend between respective laterally outer ends of the second lower wall 96 and the second upper wall 98. Thus, the second side wall 100 can be planar along a plane that is defined by the transverse direction T and the longitudinal direction L. The second side wall 100 can define a first surface 100*a* that faces a direction in which the second lower and upper walls 96 and 98 extend from the second side wall 100. The second side wall 100 can define a second surface 100*b* that faces opposite the first surface 100*a*. Further, the second electrically conductive ground shield 70 can define a second outer longitudinal end 70*a*.

Each of the second lower wall 96, the second upper wall 98, and the second side wall 100 can define a distance along a second plane that intersects the second ground shield 70 and is oriented along the transverse direction T and the lateral direction A. The distance of the second lower wall 96 and the second upper wall 98 can be equal to each other. Alternatively, the distance of the second lower wall 96 and the second upper wall 98 can be different than each other. The distance of the second side wall 100 can be equal to, greater than, or less than either or both of the distance of the second lower wall 96 and the distance of the second upper wall 98. For instance, as illustrated in FIGS. 7A-7B, the distance of the second side wall 100 can be less than each of the distance of the second lower wall 96 and the distance of the second upper wall 98.

As illustrated in FIGS. 5B-5F, the first and second ground shield 48 and 70 can mate with each other along the longitudinal direction L such that one of the first and second ground shields 48 and 70 nests within the other of the first and second ground shields 48 and 70. For instance, the second ground shield 70 can nest within the first ground shield 48, such that both the first and second ground shields 48 and 70 surrounds the mated region of the first and second mating ends 32*a* and 36*a* on at least three sides. Thus, the mated region can be disposed between and aligned with each of the first lower wall 90, the first upper wall 92, the second lower wall 96, and the second upper wall 98. Further, the first ground shields 48 can at least partially surround respective ones of the first plurality of contacts 32. The second ground shields can at least partially surround respective ones of the second plurality of contacts 36.

In accordance with one embodiment, the inner surface 94*a* of the first side wall 94 can face the inner surface 100*a* of the second side wall 100. Further, the first side wall 94 can be spaced from the second side wall 100 along the lateral direction A. Further, each of the second lower wall 96 and the second upper wall 98 can be disposed between the first lower wall 90 and the first upper wall 92. For instance, the second lower wall 96 can contact a surface of the first lower wall 90. In one example, the second lower wall 96 can contact a surface of the first lower wall 90 that faces the first upper wall 92. Thus, at least a portion of the second lower wall 96 can overlap the first lower wall 90 along the transverse direction T at a lower region of overlap. Similarly, the second upper wall 98 can contact a surface of the first upper wall 92. In one example, the second upper wall 98 can contact a surface of the first upper wall 92 that faces the first lower wall 90. Thus, at least a portion of the second upper wall 98 can overlap the first upper wall 92 along the transverse direction T at an upper region of overlap.

Thus, the first and second shields 48 and 70 can cooperate so as to entirely surround the mated region of the first and second mating ends 32*a* and 36*a* along a plane that extends through the mated region and is defined by the transverse direction T and the lateral direction A. Further, a straight line oriented along the transverse direction T can intersect four different walls of the first and second ground shields 48 and 70 when the first and second ground shields 48 and 70 are mated with each other. The lower region of overlap, the upper region of overlap, the first side wall 94, and the second side wall 100 can combine so as to define an interior void 101 when the first and second electrical shields 48 and 70 are mated with each other. The interior void 101 can be enclosed along a plane that intersects the upper and lower regions of overlap and is oriented along the transverse direction T and the lateral direction A.

Figure 6A:
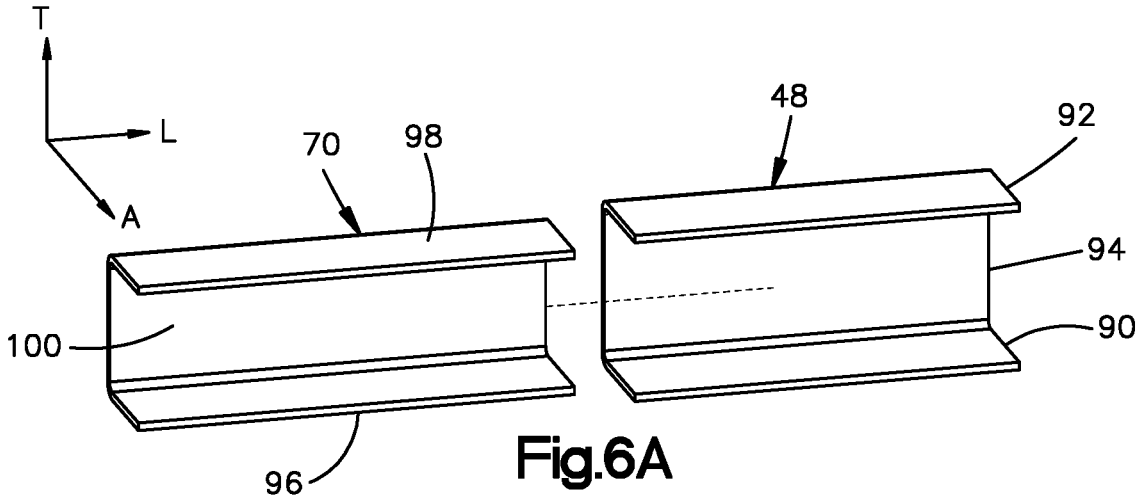
FIG. 6A is an exploded perspective view of first and second ground shields of first and second electrical connectors aligned to be mated in accordance with another embodiment.
Figure 6B:
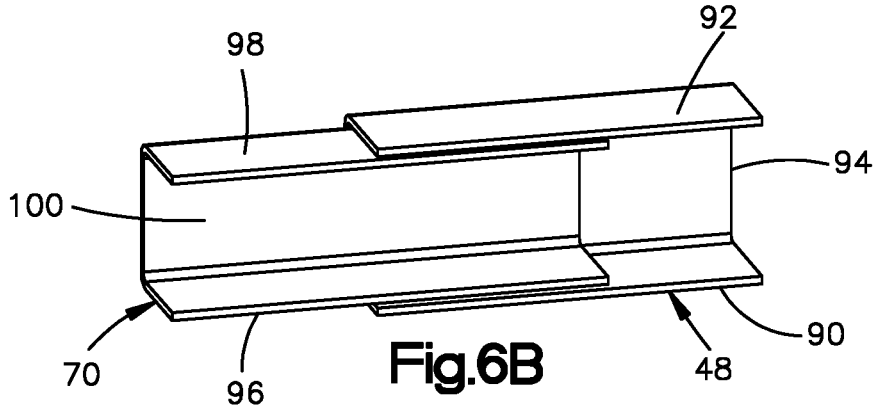
FIG. 6B is a perspective view of first and second ground shields illustrated in FIG. 6A, shown mated to each other.
Figure 6C:
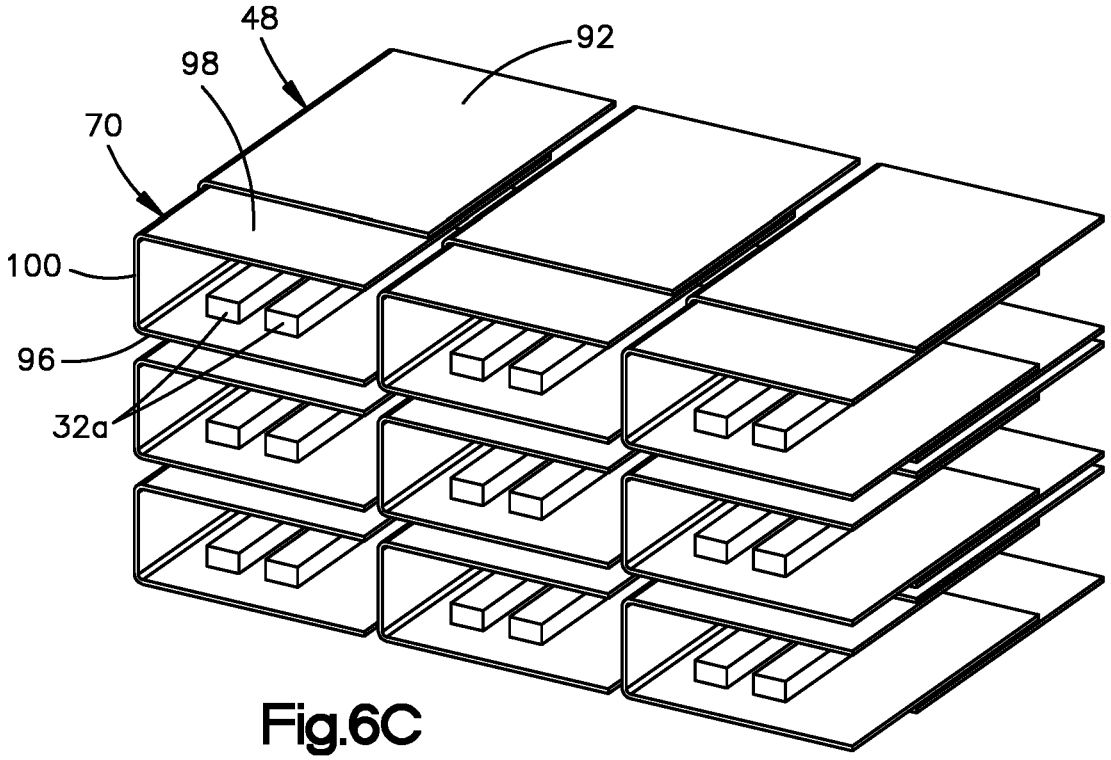
FIG. 6C is a perspective view of an array of first and second ground shields similar to the first of first and second ground shields of FIG. 6B, shown mated and offset with respect to each other in accordance with another embodiment, and further shown surrounding respective differential signal pairs.

Referring to FIGS. 6A-6C, the first and second ground shield 48 and 70 can mate with each other along the longitudinal direction L such that one of the first and second ground shields 48 and 70 nests within the other of the first and second ground shields 48 and 70 in accordance with an alternative embodiment. For instance, the second ground shield 70 can nest within the first ground shield 48 in accordance with the alternative embodiment. In particular, the second outer surface 100*b* of the second side wall 100 can face the first inner surface 94*a* of the first side wall 94. For instance, the second outer surface 100*b* of the second side wall 100 can abut the first inner surface 94*a* of the first side wall 94. The second outer lateral end 96*b* of the second lower wall 96 can be spaced from the second inner surface 100*a* a distance along the lateral direction A that is greater than a distance along the lateral direction A from the second inner surface 100*a* to the first outer lateral end 90*b* of the first lower wall 90. Similarly, the second outer lateral end 98*b* of the second upper wall 98 can be spaced from the second inner surface 100*a* a distance along the lateral direction A that is greater than a distance along the lateral direction A from the second inner surface 100*a* to the first outer lateral end 92*b* of the first upper wall 20.

Further, each of the second lower wall 96 and the second upper wall 98 can be disposed between the first lower wall 90 and the first upper wall 92. For instance, the second lower wall 96 can contact a surface of the first lower wall 90. In one example, the second lower wall 96 can contact a surface of the first lower wall 90 that faces the first upper wall 92. Thus, at least a portion of the second lower wall 96 can overlap the first lower wall 90 along the transverse direction T at a lower region of overlap. Similarly, the second upper wall 98 can contact a surface of the first upper wall 92. In one example, the second upper wall 98 can contact a surface of the first upper wall 92 that faces the first lower wall 90. Thus, at least a portion of the second upper wall 98 can overlap the first upper wall 92 along the transverse direction T at an upper region of overlap. Accordingly, a straight line oriented along the transverse direction T can intersect four different walls of the first and second ground shields 48 and 70 when the first and second ground shields 48 and 70 are mated with each other. The lower region of overlap, the upper region of overlap, the first side wall 94, and the second side wall 100 can combine so as to define an interior void 101 when the first and second electrical shields 48 and 70 are mated with each other. The interior void 101 can be open in the lateral direction A along a plane that intersects the upper and lower regions of overlap and is oriented along the transverse direction T and the lateral direction A.

Figure 7:
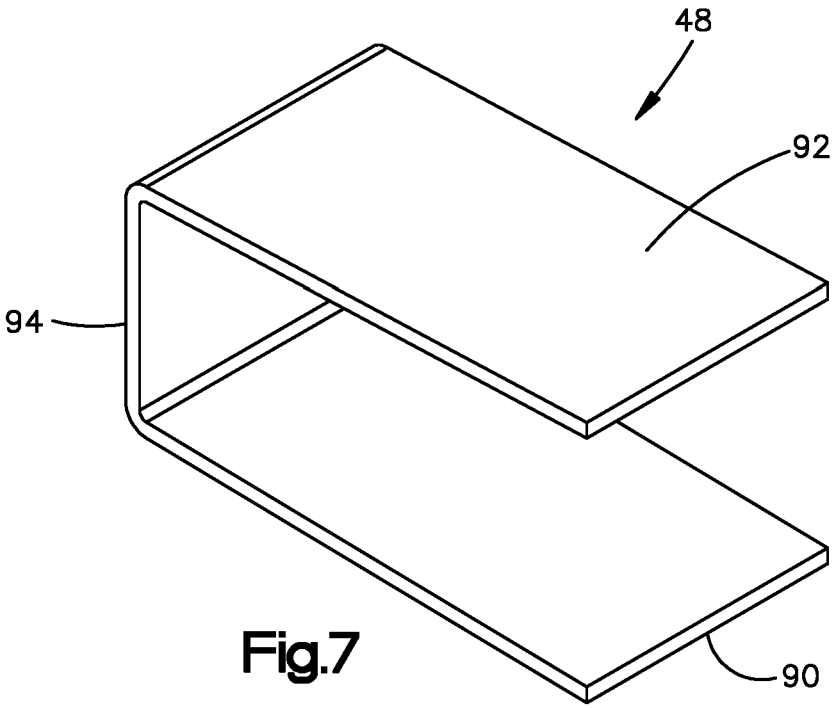
FIG. 7 illustrates an ANSYS shell element simulation of one of the first and second ground shields.

Referring now to FIG. 7, the first lower and upper walls 90 and 92 are elastically deflectable with respect to the first side wall 94 away from each other. Accordingly, mating of the first and second ground shields 48 and 70 can create a normal force between the second lower and upper walls 96 and 98 and the first lower and upper walls 90 and 92, respectively.

Figure 8:
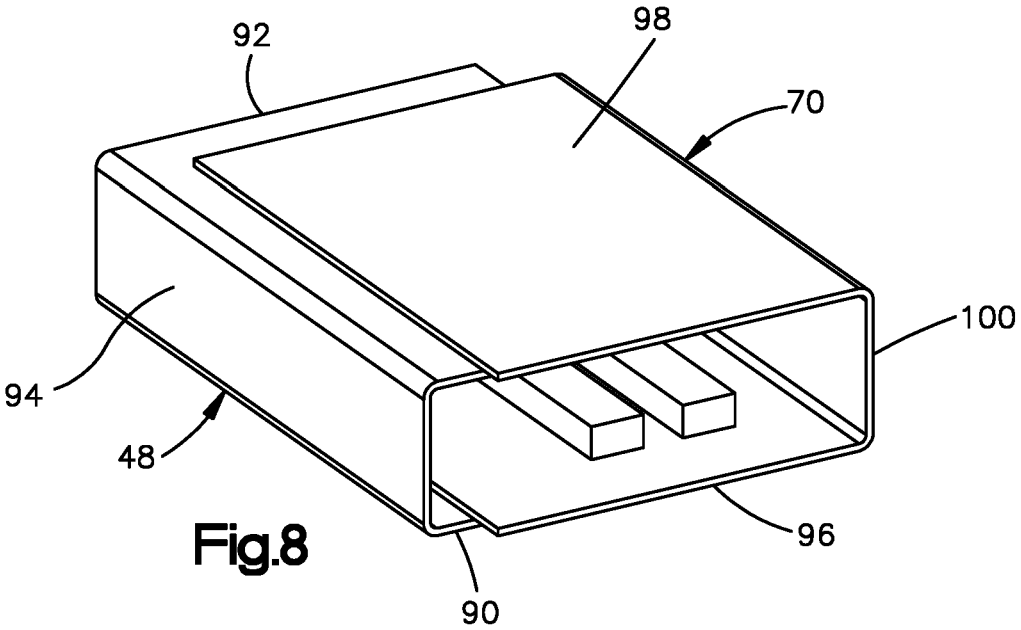
FIG. 8 is a perspective view of first and second ground shields of first and second electrical connectors mated in accordance with another embodiment, shown surrounding a differential signal pair.
Figure 9A:
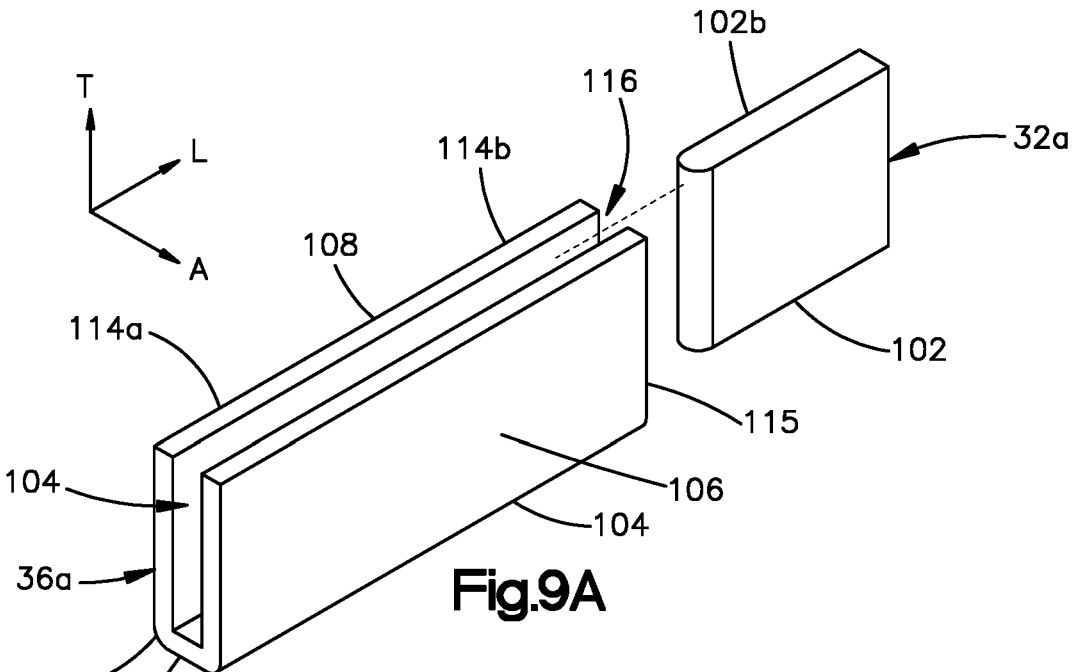
FIG. 9A is an exploded perspective view of first and second mating ends aligned to be mated with each other.
Figure 9B:
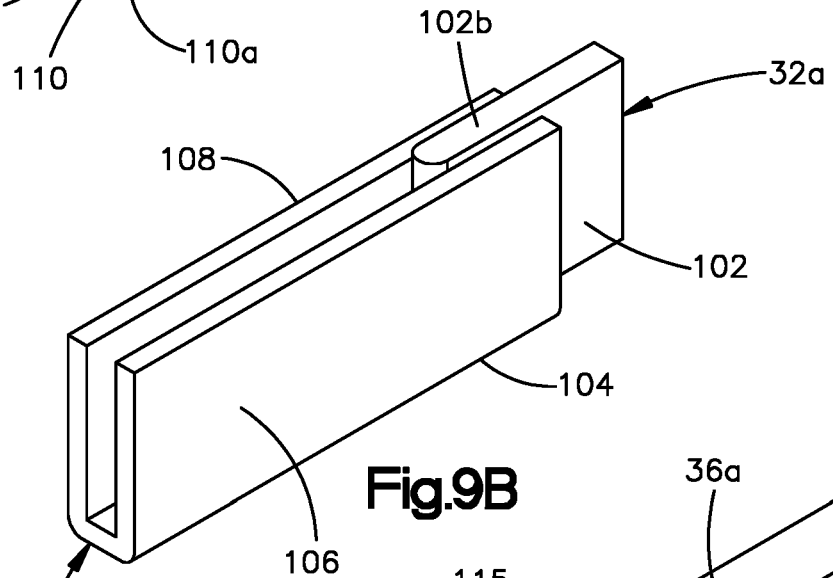
FIG. 9B is a perspective view showing the first and second mating ends as they are mated with each other.
Figure 9C:
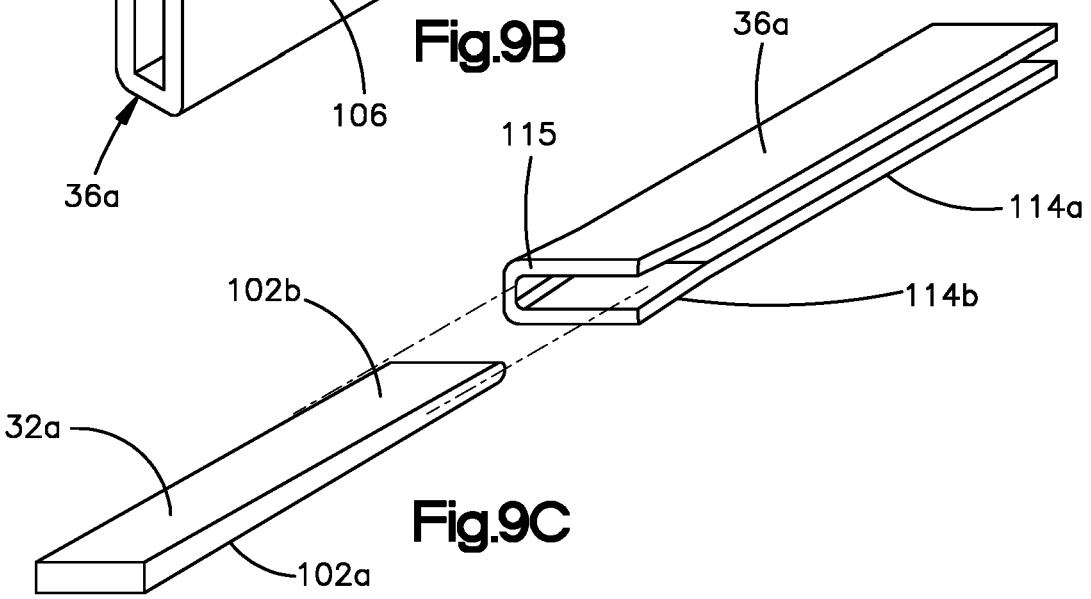
FIG. 9C is another exploded perspective view showing the first and second mating ends aligned to be mated with each other.
Figure 9D:
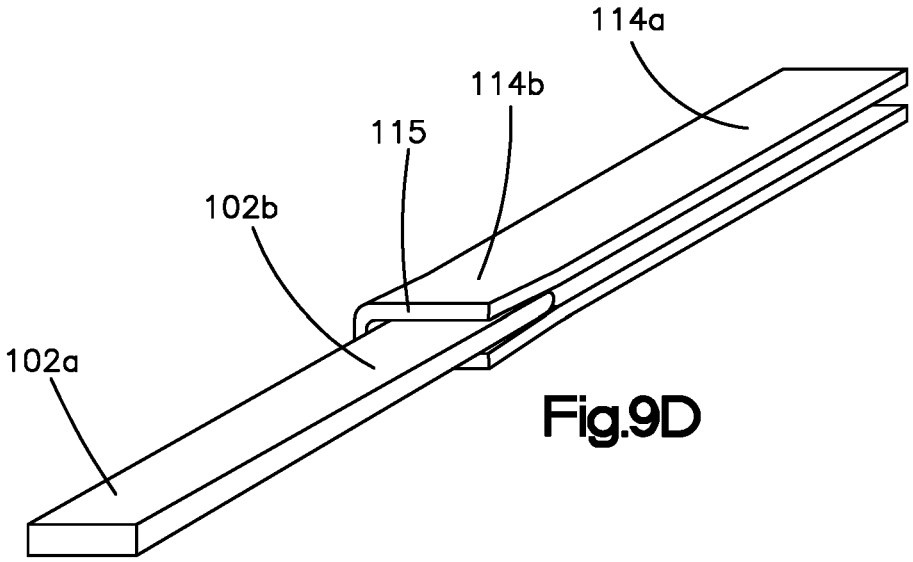
FIG. 9D is a perspective view showing the first and second mating ends of FIG. 9C as they are mated with each other.
Figure 9E:
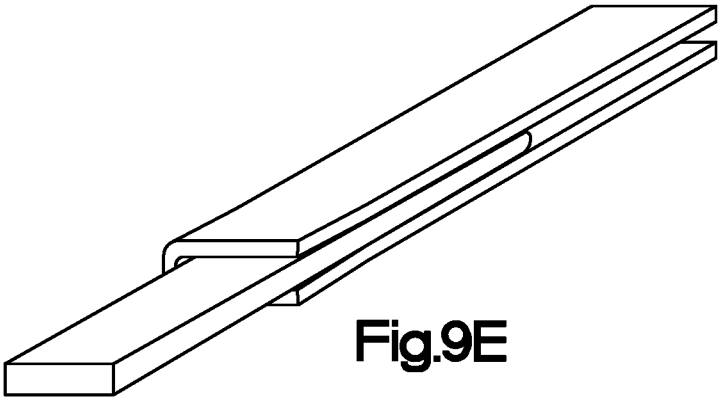
FIG. 9E is a perspective view showing the first and second mating ends of FIG. 9D as they are further mated with each other.
Figure 9F:
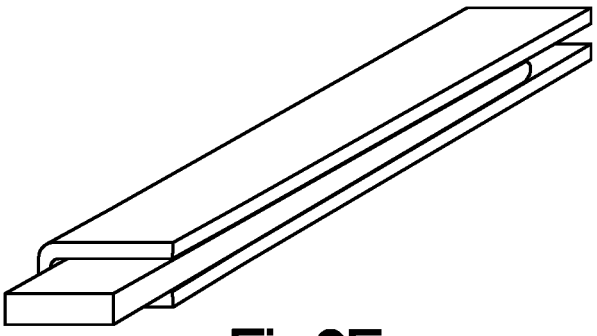
FIG. 9F is a perspective view showing the first and second mating ends mated with each other.

Referring to FIG. 8, the first and second ground shield 48 and 70 can mate with each other along the longitudinal direction L such that one of the first and second ground shields 48 and 70 nests within the other of the first and second ground shields 48 and 70 in accordance with an alternative embodiment. For instance, the inner surface 94*a* of the first side wall 94 can face the inner surface 100*a* of the second side wall 100. Further, the first side wall 94 can be spaced from the second side wall 100 along the lateral direction A. The second lower wall 96 can be disposed between the first lower wall 90 and the first upper wall 92 with respect to the transverse direction T. Further, the second lower wall 96 can contact a surface of the first lower wall 90. In one example, the second lower wall 96 can contact a surface of the first lower wall 90 that faces the first upper wall 92. Similarly, the first upper wall 92 can be disposed between the second lower wall 96 and the second upper wall 98 with respect to the transverse direction T. Further, the first upper wall 92 can contact a surface of the second upper wall 98. In one example, the first upper wall 92 can contact a surface of the second upper wall 98 that faces the second lower wall 96.

Alternatively, the first lower wall 90 can be disposed between the second lower wall 96 and the second upper wall 98 with respect to the transverse direction T. Further, the first lower wall 90 can contact a surface of the second lower wall 96. In one example, the first lower wall 90 can contact a surface of the second lower wall 96 that faces the second upper wall 98. Similarly, the second upper wall 96 can be disposed between the first lower wall 90 and the first upper wall 92 with respect to the transverse direction T. Further, the second upper wall 96 can contact a surface of the first upper wall 92. In one example, the second upper wall 96 can contact a surface of the first upper wall 92 that faces the first lower wall 90.

Thus, at least a portion of the second lower wall 96 can overlap the first lower wall 90 along the transverse direction T at the lower region of overlap. Similarly, at least a portion of the second upper wall 98 can overlap the first upper wall 92 along the transverse direction T at the upper region of overlap. Accordingly, a straight line oriented along the transverse direction T can intersect four different walls of the first and second ground shields 48 and 70 when the first and second ground shields 48 and 70 are mated with each other. The lower region of overlap, the upper region of overlap, the first side wall 94, and the second side wall 100 can combine so as to define an interior void 101 when the first and second electrical shields 48 and 70 are mated with each other. The interior void 101 can be enclosed along the plane that intersects the upper and lower regions of overlap and is oriented along the transverse direction T and the lateral direction A.

As illustrated in FIGS. 5C-6C and FIG. 8, one the first and second ground shields 48 and 70 can be offset with respect to the other along the longitudinal direction L. That is, the outer end 48*a* can be spaced from the outer end 70*a* in a select direction that is along the longitudinal direction L. Accordingly, a first straight line that is oriented along the transverse direction T can intersect each of the first lower wall 90 and the first upper wall 92 without passing through either of the second lower wall 96 and the second upper wall 98. In particular, the first straight line can be offset from the second ground shield 70 along the longitudinal direction L. Similarly, a second straight line that is oriented along the transverse direction T can intersect each of the second lower wall 96 and the second upper wall 98 without passing through either of the first lower wall 90 and the first upper wall 92. In particular, the second straight line can be offset from the first ground shield 48 along the longitudinal direction L. The upper and lower regions of overlap can be disposed between the first and second straight lines with respect to the longitudinal direction L.

In accordance with one example, as the first and second ground shields 48 and 70 are mated, the outer end 48*a* is moved toward the outer end 70*a*, until the outer end 48*a* passes the outer end 70*a*. As described above, the first and second first mating ends 32*a* and 36*a* can be mated to each other while the first and second ground shields 48 and 70 are mated to each other. Because the first and second ground shields 48 and 70 can be offset with respect to each other along the longitudinal direction L as described above, an electrical connector assembly that includes the first and second ground shields 48 and 70 can maintain shielding at the first and second electrical contacts 32 and 36 when the electrical contacts 32 and 36 are partially unmated (e.g., not fully mated). It should be appreciated that the terms "upper" and "lower" and derivatives thereof as used herein refer to the ground shields 48 and 70 oriented as illustrated in the Figures, but it is appreciated that the orientation of the ground shields 48 and 70 can vary during use.

Referring now to FIGS. 9A-9F, it should be appreciated that the first and second mating ends 32*a* and 36*a* can be configured in accordance with any suitable alternative embodiment as desired. For instance, one of the first and second mating ends 32*a* and 36*a* can be configured as a beam 102, and the other of the first and second mating ends 32*a* and 36*a* can define a receptacle 104 that receives the beam 102. In one example, the first mating end 32*a* can define the beam 102, and the second mating end 36*a* can define the receptacle 104. In particular, the first mating end 32*a* can define a first trailing portion 102*a* and a first leading portion 102*b*. The first leading portion 102*b* can be twisted with respect to the first trailing portion 102*a*. The first leading portion 102*b* can be spaced from the first trailing portion 102*a* along the longitudinal direction L. Further, the first leading portion 102*b* can be inline with the first trailing portion 102*a* along the longitudinal direction L. The beam 102 can define a twisted interface that extends between the first trailing portion 102*a* and the first leading portion 102*b*. A first straight line that bisects each of the edges of the first mating end 32*a* extends along a first direction in a first plane that intersects the first trailing portion 102*a* and is defined by the transverse direction T and the lateral direction A. A second straight line that bisects each of the edges of the first mating end 32*a* extends along a second direction in a second plane that intersects the first leading portion 102*b* and is parallel to the first plane. The second direction is different than the first direction. For instance, the second direction can be angularly offset from the first direction in a first rotational direction. The first rotational direction can be about an axis of rotation that is oriented along the longitudinal direction L. The angular offset can be in a range having a lower end of approximately two degrees and an upper end of approximately 45 degrees. The first direction can be oriented along the transverse direction T. The first leading portion 102*b* can be disposed forward of the first trailing portion 102*a* in the mating direction in which the first electrical connector 22 mates with the second electrical connector 24. Thus, the first leading portion 102*b* can engage the second mating end 36*a* before the first trailing portion 102*a* engages the second mating end 36*b* when the first and second electrical contacts 32 and 36 are mated to each other.

The beam 102 can have a width at the first trailing portion 102*a* along the lateral direction A. The width can extend from a first external surface of the beam 102 to a second external surface of the beam 102 opposite the first external surface along the lateral direction A. In one example, the width at the first trailing portion 102*a* can extend from one of the broadsides to the other of the broadsides along the lateral direction A. For instance, the width of the beam 102 at the first leading portion 102*b* can be defined by a distance of offset along the lateral direction A between diagonally opposed first and second interfaces between respective different broadsides and edges of the first mating end 32*a* at the first leading portion 102*b*.

The second mating end 36*a* can be substantially U-shaped. Thus, the second mating end 36*a* can include a first side wall 106, a second side wall 108 opposite the first side wall 106, and a base 110 that extends from the first side wall 106 to the second side wall 108. The first and second side walls 106 and 108 and the base 100 cooperate to define the receptacle 104. The receptacle 104 can be open opposite the base 110. At least a portion of the first side wall 106 can be parallel with at least a portion of the second side wall 108. Further, the first side wall 106 can be spaced from the second side wall 108 along the lateral direction A. The base 110 can define first and second opposed laterally outer ends 110*a* and 110*b*. The outer ends 100*a* and 110*b* can be opposite each other along the lateral direction A. The first side wall 106 can extend from the first outer end 110*a*, and the second side wall 108 can extend from the second outer end 110*b*. The first and second side walls 106 and 108 can be oriented perpendicular with respect to the base 110.

The second mating end 36*a* can define a second trailing portion 114*a* and a second leading portion 114*b* that is spaced from the second trailing portion 114*a* in the respective forward direction of the second electrical connector 24. Accordingly, the second leading portion 114*b* engages the first mating end 32*a* before the second trailing portion 114*a* engages the first mating end 32*a* when the first and second electrical contacts 32 and 36 are mated to each other. The first and second side walls 106 and 108 can be spaced from each other a first distance at the second trailing portion 114*a*. The first distance can be measured along the lateral direction A. The first and second side walls 106 and 108 can be spaced from each other a second distance at the second leading portion 114*b*. The second distance can be measured along the lateral direction A. The second distance can be greater than the first distance. The second leading portion 114*b* can define a forward end 115 that defines an opening 116 to the receptacle 104. The opening 116 can be open to the receptacle 104 along the longitudinal direction. For instance, opening 116 can be open to the receptacle 104 in the rearward direction of the second electrical connector 24. The opening 116 is configured to receive the first mating end 36*a* when the first electrical contact 32 is mated with the second electrical contact 36. Thus, the opening 116 has a width along the lateral direction A that is greater than the width of the beam 102 at the first leading portion 102*b* along the lateral direction A. Further, the width of the opening 116 is greater than the width of the second leading portion 114*b* between the forward end 115 and the second trailing portion 114*a*. Otherwise stated, the width of the second leading portion 114*b* can decrease in a direction from the forward end 115 to the second trailing portion 114*a*. In this regard, the second leading portion 114*b* can also be referred to as a neck.

At least one or both of the first and second side walls 106 and 108 can flare away from the other of the first and second side walls 106 and 108 as they extend toward the forward end 115 in the forward direction. For instance, at least one or both of the first and second side walls 106 and 108 can flare away from the other of the first and second side walls 106 and 108 from the second trailing portion 114*a* to the forward end 115. The first and second side walls 106 and 108 can be parallel to each other at the second trailing portion 114*a*. Further, the base 110 can define a width from one of the outer ends 110*a* to the other of the outer ends 110*b* along the lateral direction A. The width can increase as the base 110 extends toward the forward end 115 in the forward direction. For instance, the width can increase from the second trailing portion 114*a* to the forward end 115. The width of the base 110 can be constant at the second trailing portion 114*a*.

When the first and second mating ends 32*a* and 36*a* are to be mated to each other, the first leading portion 102*b* of the first mating end 32*a* is placed in alignment with the opening 116 of the forward end 115 of the second mating end 36*a* along the longitudinal direction. Next, the first leading portion n102*b* is inserted into the opening 116 of the forward end 115 of the second mating end 36*a* substantially along the longitudinal direction. When the first and second mating ends 32*a* and 36*a* are mated to each other, the first leading portion 102*b* of the first mating end 32*a* is first inserted into the opening 116 of the forward end of the second mating end 36*a*. Because the distance from the first side wall 106 to the second side wall 108 is greater than the width of the first leading portion 102*b*, the opening 116 is sized to receive the first leading portion 102*b*. As the first and second electrical contacts 32 are further mated with each other, the first leading portion 102*b* travels into the second leading portion 102*b* at a location between the forward end 115 and the second trailing portion 102*b*. Because the second distance at the second leading portion 114*b* is greater than the second width of the first leading portion 102*b*, the first leading portion 102*b* of the first mating end 32*a* can be inserted into the second leading portion 114*b* of the second mating end 36*a*. As the first and second mating ends 32*a* and 36*a* are further mated to each other, the first leading portion 102*b* is inserted into the second leading portion 114*b* in a direction from the forward end 115 toward the second trailing portion 114*a*.

As described above, the distance from the first side wall 106 to the second side wall 108 along the lateral direction A decreases at the second leading portion 114*b* in the direction from the forward end 115 toward the second trailing portion 114*a*. The distance from the first side wall 106 to the second side wall 108 along the lateral direction A can be taper in the second leading portion 114*b* to a distance that is less than the width of the beam 102 at the first leading portion 102*b* that is defined by a distance of offset along the lateral direction A between diagonally opposed first and second interfaces between respective different broadsides and edges of the first mating end 32*a* at the first leading portion 102*b*. Thus, the first leading portion 102*b* is brought into contact with the first and second side walls 106 and 108.

Because the first electrical contacts 32 are rigidly supported by the respective connector housing, and because the second mating end 36*a* is rotationally stiffer than the first mating end 32*a*, contact with the first and second side walls 106 and 108 causes the first leading portion 102*b* to rotate about the axis of rotation in a second direction of rotation opposite the first direction of rotation. The first leading portion 102*b* can rotate in the second direction of rotation an angular distance equal to or less than the angular offset. Because the distance between the first and second side walls 106 and 108 along the lateral direction A at the second trailing portion 114*a* can be slightly greater than the width of the beam 102 at the first trailing portion 102*a*, the edges and broadsides of the beam 102 at the first leading portion 102*b* can become substantially inline with the edges and broadsides of the beam 102 at the first trailing portion 102*a* when the first leading portion 102*b* is disposed in the second trailing portion 114*a*. Further, at least a portion of the rotation of the first leading portion 102*b* in the second direction of rotation can be elastic. Accordingly, frictional forces resulting from contact between the first leading portion 102*b* and the second trailing portion 114*a* can be overcome by an insertion force that causes the first and second electrical contacts 32 and 36 to mate with each other. Further, the frictional forces resulting from contact between the first leading portion 102*b* and the second trailing portion 114*a* creates a retention force that resists separation of the first and second electrical contacts 32 and 36 along the longitudinal direction that would cause the first and second electrical contacts 32 and 36 to unmate from each other.

While the first and second electrical contacts 32 and 36, including the respective mating ends 32*a* and 36*a* have been described as included in the first and second electrical connectors 22 and 24, it should be appreciated that the first and second electrical contacts 32 and 36 can be included in any suitable connector as desired. Similarly, while the first and second ground shields 48 and 70 have been described as included in the first and second electrical connectors 22 and 24, it should be appreciated that the first and second ground shields 48 and 70 can be included in any suitable connector as desired.

For instance, the first electrical connector can be configured as a vertical electrical connector, whereby the first mating ends 32*a* are oriented parallel to the mounting end of the first electrical contacts 32. The mounting ends of the ground shields 48 can similarly be oriented parallel to the region of the ground shields 48 that mate with the ground shields 70. Alternatively, the first electrical connector can be shieldless. Alternatively, the first electrical connector can be configured as a right-angle electrical connector, whereby the first electrical contacts 32 are bent inside the connector housing such that the first mating ends 32*a* are oriented perpendicular to the mounting end of the first electrical contacts 32. The ground shields 48 can similarly be bent inside the connector housing such that the mounting ends of the ground shields 48 can similarly be oriented perpendicular to the region of the ground shields 48 that mate with the ground shields 70. Alternatively, the first electrical connector can be shieldless.

Similarly, the second electrical connector can be configured as a vertical electrical connector, whereby the first mating ends 36*a* are oriented parallel to the mounting ends of the second electrical contacts 36. The mounting ends of the ground shields 70 can similarly be oriented parallel to the region of the ground shields 70 that mate with the ground shields 48. Alternatively, the second electrical connector can be shieldless. Alternatively, the second electrical connector can be configured as a right-angle electrical connector, whereby the second electrical contacts 36 are bent inside the connector housing such that the first mating ends 36*a* are oriented perpendicular to the mounting ends of the second electrical connectors 36. The ground shields 70 can similarly be bent inside the connector housing such that the mounting ends of the ground shields 70 can similarly be oriented perpendicular to the region of the ground shields 70 that mate with the ground shields 48. Alternatively, the second electrical connector can be shieldless.

The electrical connector assembly 20 can thus include a vertical first electrical connector and a right-angle second electrical connector. Alternatively the electrical connector assembly 20 can include a vertical first electrical connector and a vertical second electrical connector. Alternatively still, the electrical connector assembly 20 can include a right-angle first electrical connector and a vertical second electrical connector. Alternatively the electrical connector assembly 20 can include a right-angle first electrical connector and a right-angle second electrical connector.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Further, structure and methodologies described in connection with one electrical connector herein can apply equally to the other electrical connector in certain examples. Those skilled in the relevant art, having the benefit of the teachings of this specification, may effect numerous modifications to the invention as described herein, and changes may be made without departing from the spirit and scope of the invention as defined by the appended claims.

What is claimed:

1. An electrical connector comprising:

a dielectric connector housing that defines a first end and a second end;

a plurality of electrical contacts arranged in rows including a first row and a second row, the plurality of electrical contacts being supported by the connector housing, wherein each electrical contact of the plurality of electrical contacts defines a mounting end that extends out from the first end of the connector housing and is configured to be mounted to a substrate, each electrical contact of the plurality of electrical contacts further comprises mating ends, opposite the mounting ends, wherein the plurality of electrical contacts are arranged in pairs of differential signal contacts; and a plurality of ground shields supported by the connector housing, each of the plurality of ground shields comprising a plurality of walls, each of the plurality of ground shields enclosing, at least partially, a respective pair of differential signal contacts, wherein the mounting ends of the plurality of electrical contacts are disposed along a first surface of the housing so as to form a mounting interface and the mating ends of the plurality of electrical contacts in the first row are offset in a direction parallel to the mounting interface relative to the mating ends of the plurality of electrical contacts in the second row.

2. The electrical connector as recited in claim 1, wherein the mating ends of the plurality of electrical contacts in the first row are disposed along a second surface so as to form a mating interface, wherein the second surface and the first surface are oriented substantially perpendicular to each other.

3. The electrical connector as recited in claim 1, wherein each ground shield comprises a lower wall, an upper wall opposite the lower wall, and a side wall connecting the lower wall to the upper wall, wherein the respective pair of differential signal pairs is disposed between the lower wall and the upper wall.

4. The electrical connector as recited in claim 1, further comprising a plurality of dielectric members supported by the connector housing, each of the plurality of dielectric members being in contact with a respective pair of differential signals contacts.

5. The electrical connector as recited in claim 4, wherein each of the plurality of ground shields surrounds the respective pair of differential signals contacts on three sides.

6. The electrical connector as recited in claim 1, wherein the connector housing includes a housing body that defines the first and second ends, and the connector housing further comprises at least one stop member that extends out from the housing body and is configured to abut a complementary electrical connector when the electrical connector is mated with the complementary electrical connector.

7. The electrical connector as recited in claim 1, wherein at least one of the plurality of electrical contacts comprises a bent region disposed outside the connector housing.

8. An electrical connector comprising:

a plurality of electrical contacts arranged in pairs of differential signal contacts, wherein each of the plurality of electrical contacts are elongated along a first direction from a mounting end to a mating end, wherein the mounting end is configured to be mounted to a substrate, and the mating end is configured to mate with a complementary electrical contact of a complementary electrical connector in a forward direction that is along the first direction;

a dielectric connector housing that supports the plurality of electrical contacts and defines a first end and a second end opposite the first end along the first direction, wherein the mounting end extends out from the first end of the connector housing; and a plurality of ground shields supported by the connector housing, each of the plurality of ground shields comprising a plurality of walls, each of the plurality of ground shields enclosing, at least partially, a respective pair of differential signal contacts, wherein the second end of the connector housing includes a plurality of flats and risers that extend between adjacent ones of the flats, the mating ends extend out from respective ones of the risers, and adjacent ones of the risers are offset from each other along the first direction and a second direction perpendicular to the first direction.

9. The electrical connector as recited in claim 8, wherein adjacent ones of the risers are equidistantly offset from each other along the first direction.

10. The electrical connector as recited in claim 8, wherein adjacent ones of the risers are equidistantly offset from each other along the second direction.

11. The electrical connector as recited in claim 8, wherein sequentially adjacent ones of the risers are offset from each other in the forward direction.

12. The electrical connector as recited in claim 8, wherein the electrical contacts define blades that are substantially linear from the mounting ends to the mating ends.

13. The electrical connector as recited in claim 8, wherein the connector housing includes a housing body that defines the first and second ends, and the connector housing further comprises at least one stop member that extends out from a respective at least one of the flats, the at least one stop member configured to abut the complementary electrical connector when the electrical connector is mated with the complementary electrical connector.

14. The electrical connector as recited in claim 8, wherein the connector housing defines a respective external surface at the first end, and respective external surfaces at the second end, the at mating end of each of the electrical contacts extends out the connector housing through respective ones of the respective external surfaces at the second end, the mounting end of each of the electrical contacts extends out the connector housing through the respective external surface at the first end, and the respective external surfaces at the second end are oriented substantially parallel to the respective external surface at the first end.

15. An electrical connector assembly comprising:

a first electrical connector including a dielectric first connector housing and a plurality of first electrical contacts supported by the first connector housing, wherein the plurality of first electrical contacts define a first mounting end that is configured to be mounted to a first substrate, the plurality of first electrical contacts further define a first mating end, and each of the plurality of first electrical contacts comprises a twisted beam; and a second electrical connector including a dielectric second connector housing and a plurality of second electrical contacts supported by the second connector housing, wherein the plurality of second electrical contacts define a second mounting end, the plurality of second electrical contacts further define a second mating end, wherein each of the plurality of second electrical contacts comprises a receptacle positioned to receive therein a respective twisted beam of the plurality of first electrical contacts.

16. The electrical connector assembly as recited in claim 15, wherein the twisted beam comprises a leading portion and a trailing portion, the leading portion being twisted relative to the trailing portion.

17. The electrical connector assembly as recited in claim 15, further comprising a plurality of ground shields supported by the first connector housing, each of the plurality of ground shields comprising a plurality of walls, each of the plurality of ground shields enclosing, at least partially, a respective pair of the plurality of first electrical contacts.

18. The electrical connector assembly as recited in claim 17, wherein each of the plurality of ground shield surrounds the respective pair on three sides.

19. An electrical connector assembly comprising:

a first electrical connector including a dielectric first connector housing and at least one first electrical contact supported by the first connector housing, wherein the first electrical contact defines a first mounting end that is configured to be mounted to a first substrate, the first electrical contact further defines a first mating end opposite the first mounting end; and a second electrical connector including a dielectric second connector housing and at least one second electrical contact supported by the second connector housing, wherein the second electrical contact defines a second mounting end that is configured to be mounted to a second substrate, the second electrical contact second defines a second mating end opposite the first mounting end, wherein the first and second mating ends are configured to mate with each other at a mated region when the first and second electrical connector are mated with each other, wherein the first electrical connector comprises a first ground shield that at least partially surrounds the first electrical contact, and the second electrical connector comprises a second ground shield that at least partially surrounds the second electrical contact, such that the second ground shield is configured to nest in the first ground shield.

20. The electrical connector assembly as recited in claim 19, wherein:

the first ground shield comprises a first lower wall, a first upper wall opposite the first lower wall, and a first side wall that is connected between the first lower wall and the first upper wall, such that the first electrical contact is disposed between and aligned with the first lower wall and the first upper wall, the second ground shield comprises a second lower wall, a second upper wall opposite the second lower wall, and a second side wall that is connected between the second lower wall and the second upper wall, such that the second electrical contact is disposed between and aligned with the second lower wall and the second upper wall, and the mated region is disposed between and aligned with each of the second lower wall and the second upper wall when the first and second electrical connectors are mated to each other.

21. The electrical connector assembly as recited in claim 20, wherein the first and second ground shields surround the mated region on at least three sides.

22. The electrical connector assembly as recited in claim 20, wherein when the first and second ground shields are nested, the first upper wall abuts the second upper wall, the first lower wall abuts the second lower wall, an outer surface of the second side wall faces an inner surface of the first side wall.

23. The electrical connector assembly as recited in claim 22, wherein, the first upper wall and the first lower wall extend from the first side wall in a first select direction, and the inner surface of the first side wall faces the first select direction, and the second upper wall and the second lower wall extend from the second side wall in a second select direction, the second side wall defines a second inner surface that faces the select direction, and outer surface of the second side wall faces a direction opposite the select direction.

* * * * *